US009462846B2

(12) United States Patent
Litchfield et al.

(10) Patent No.: US 9,462,846 B2
(45) Date of Patent: Oct. 11, 2016

(54) TRAINING FOOTWEAR

(71) Applicant: Reebok International Limited, London (GB)

(72) Inventors: Paul E. Litchfield, Westborough, MA (US); William McInnis, Westwood, MA (US); Michael Andrews, East Falmouth, MA (US); Kevin Leary, Dedham, MA (US); Ricardo Vestuti, Providence, RI (US); Brian Christensen, Centerville, MA (US); Paul Shinney, Braintree, MA (US)

(73) Assignee: REEBOK INTERNATIONAL LIMITED, London (GB)

( * ) Notice: Subject to any disclaimer, the term of this patent is extended or adjusted under 35 U.S.C. 154(b) by 278 days.

(21) Appl. No.: 14/220,819

(22) Filed: Mar. 20, 2014

(65) Prior Publication Data

US 2014/0215849 A1 Aug. 7, 2014

Related U.S. Application Data

(60) Continuation of application No. 13/829,695, filed on Mar. 14, 2013, now Pat. No. 8,713,817, which is a division of application No. 12/571,327, filed on Sep. 30, 2009, now Pat. No. 8,424,221, which is a continuation-in-part of application No. 12/416,698, filed on Apr. 1, 2009, now Pat. No. 8,307,569.

(51) Int. Cl.

| | |
|---|---|
| ***A43B 13/18*** | (2006.01) |
| ***A43B 13/12*** | (2006.01) |
| ***A43B 13/14*** | (2006.01) |

(Continued)

(52) U.S. Cl.

CPC ..... *A43B 13/181* (2013.01); *A43B 13/12* (2013.01); *A43B 13/145* (2013.01); *A43B 13/184* (2013.01); *A43B 13/186* (2013.01);

(Continued)

(58) Field of Classification Search

CPC ... A43B 13/184; A43B 13/186; A43C 15/00
USPC ..... 36/59 R, 59 C, 28, 29
See application file for complete search history.

(56) References Cited

U.S. PATENT DOCUMENTS

| | | | |
|---|---|---|---|
| D39,747 | S | 1/1909 | McKenna |
| 1,272,556 | A | 7/1918 | Steward |

(Continued)

FOREIGN PATENT DOCUMENTS

| | | |
|---|---|---|
| EP | 1 120 056 A2 | 8/2001 |
| WO | WO 2004/016321 A2 | 2/2004 |
| WO | WO 2004/016321 A3 | 2/2004 |

OTHER PUBLICATIONS

Apos, Less Pain, More Function article, 12 pages, copyright 2008.

(Continued)

*Primary Examiner* — Marie Bays
(74) *Attorney, Agent, or Firm* — Sterne, Kessler, Goldstein & Fox, P.L.L.C.

(57) ABSTRACT

An article of footwear includes a sole having a forefoot portion, a heel portion and an outsole having a bottom surface including a primary ground contacting surface. The bottom surface of the outsole includes a forefoot bulge and a heel bulge which provide the footwear with controlled instability for providing dynamic conditioning of the wearer's muscles during the gait cycle.

18 Claims, 37 Drawing Sheets

(51) Int. Cl.

| | |
|---|---|
| ***A43B 13/20*** | (2006.01) |
| ***A43B 21/26*** | (2006.01) |
| ***A43B 21/28*** | (2006.01) |

(52) U.S. Cl.

CPC ..... *A43B13/189* (2013.01); *A43B 13/203* (2013.01); *A43B 21/265* (2013.01); *A43B 21/285* (2013.01)

(56) References Cited

U.S. PATENT DOCUMENTS

| | | | | | |
|---|---|---|---|---|---|
| 1,857,975 | A * | 5/1932 | Reynolds | A43B 5/12 | 36/113 |
| 1,979,972 | A | 11/1934 | Guild | | |
| 2,106,788 | A * | 2/1938 | Borman | A43B 21/28 | 16/86 R |
| 2,155,166 | A * | 4/1939 | Kraft | A43B 13/223 | 36/32 R |
| D123,602 | S | 11/1940 | Reeves | | |
| D125,657 | S | 3/1941 | Cutler | | |
| 2,279,891 | A * | 4/1942 | Maselter | A43B 21/06 | 36/59 R |
| 2,383,117 | A * | 8/1945 | Fellman | A43B 13/223 | 36/59 C |
| 2,393,577 | A * | 1/1946 | Urbany | A43B 13/04 | 36/29 |
| D201,952 | S * | 8/1965 | Johns | 36/59 C | |
| D234,930 | S | 4/1975 | Arambasic et al. | | |
| D265,690 | S | 8/1982 | Famolare, Jr. | | |
| D266,798 | S | 11/1982 | Famolare, Jr. | | |
| D267,288 | S | 12/1982 | Davis | | |
| D267,366 | S | 12/1982 | Davis | | |
| 4,446,634 | A | 5/1984 | Johnson et al. | | |
| 4,521,979 | A * | 6/1985 | Blaser | A43B 13/184 | 36/28 |
| 4,571,852 | A * | 2/1986 | Lamarche | A43B 3/0042 | 36/25 R |
| 4,577,417 | A | 3/1986 | Cole | | |
| 4,653,206 | A * | 3/1987 | Tanel | A43C 13/04 | 36/126 |
| 4,670,997 | A * | 6/1987 | Beekman | A43B 13/223 | 36/114 |
| 4,897,936 | A * | 2/1990 | Fuerst | A43B 13/223 | 36/114 |
| D323,059 | S | 1/1992 | Hatfield | | |
| 5,203,097 | A * | 4/1993 | Blair | A43B 13/223 | 36/114 |
| D343,051 | S | 1/1994 | Bramani | | |
| 5,313,718 | A * | 5/1994 | McMahon | A43B 13/26 | 36/114 |
| 5,416,986 | A | 5/1995 | Cole et al. | | |
| D394,939 | S | 6/1998 | Avar | | |
| D395,157 | S | 6/1998 | von Conta | | |
| 5,771,606 | A | 6/1998 | Litchfield et al. | | |
| D396,549 | S | 8/1998 | von Conta et al. | | |
| D398,440 | S | 9/1998 | Rowland | | |
| 5,806,209 | A | 9/1998 | Crowley et al. | | |
| D400,344 | S | 11/1998 | Avar | | |
| D401,043 | S | 11/1998 | Truelsen | | |
| D405,596 | S | 2/1999 | Aird et al. | | |
| 5,956,869 | A | 9/1999 | Kim | | |
| 6,018,889 | A | 2/2000 | Friton | | |
| 6,038,790 | A | 3/2000 | Pyle et al. | | |
| D426,947 | S | 6/2000 | Pollastrelli | | |
| 6,354,020 | B1 | 3/2002 | Kimball et al. | | |
| 6,460,273 | B2 * | 10/2002 | Witjes | A43B 13/32 | 36/15 |
| 6,505,420 | B1 | 1/2003 | Litchfield et al. | | |
| D482,852 | S | 12/2003 | Belley et al. | | |
| D492,096 | S | 6/2004 | Sanchez et al. | | |
| 6,745,499 | B2 | 6/2004 | Christensen et al. | | |
| 6,754,981 | B1 | 6/2004 | Edwards | | |
| 6,845,573 | B2 | 1/2005 | Litchfield et al. | | |
| D501,293 | S | 2/2005 | Bizzo | | |
| D504,555 | S | 5/2005 | Urie | | |
| 6,979,287 | B2 | 12/2005 | Elbaz et al. | | |
| 7,080,467 | B2 | 7/2006 | Marvin et al. | | |
| 7,101,330 | B2 | 9/2006 | Elbaz et al. | | |
| D532,189 | S | 11/2006 | Truelsen | | |
| 7,200,955 | B2 | 4/2007 | Foxen | | |
| D553,335 | S | 10/2007 | Amado et al. | | |
| D569,084 | S | 5/2008 | Hatfield et al. | | |
| D576,394 | S | 9/2008 | Heller | | |
| 7,475,498 | B2 | 1/2009 | Litchfield et al. | | |
| 8,220,182 | B2 * | 7/2012 | Righetto | A43B 7/144 | 36/141 |
| 8,256,146 | B2 * | 9/2012 | Loverin | A43B 3/30 | 36/102 |
| 8,307,569 | B2 * | 11/2012 | McInnis | A43B 3/0005 | 36/114 |
| 8,333,024 | B2 * | 12/2012 | Fallow | A43B 3/0042 | 36/102 |
| 8,424,221 | B2 * | 4/2013 | Litchfield | A43B 13/12 | 36/114 |
| 8,578,630 | B2 * | 11/2013 | Diepenbrock | A43B 7/144 | 36/25 R |
| 8,713,817 | B2 * | 5/2014 | Litchfield | A43B 13/12 | 36/114 |
| 8,844,170 | B2 * | 9/2014 | Ferrigan | A43B 3/0042 | 36/102 |
| 2003/0101619 | A1 | 6/2003 | Litchfield et al. | | |
| 2004/0033864 | A1 | 2/2004 | Elbaz et al. | | |
| 2004/0033874 | A1 | 2/2004 | Elbaz et al. | | |
| 2005/0268490 | A1 | 12/2005 | Foxen | | |
| 2005/0283999 | A1 | 12/2005 | Whatley | | |
| 2008/0242518 | A1 | 10/2008 | Elbaz et al. | | |
| 2009/0165333 | A1 | 7/2009 | Litchfield et al. | | |
| 2014/0059884 | A1 * | 3/2014 | Diepenbrock | A43B 7/144 | 36/28 |

OTHER PUBLICATIONS

Draft Flexyboots BmbH Patent Application dated Aug. 20, 2008, retrieved on Jun. 26, 2009 from http://www.flexiboots.ch/Patent.pdf, 42 pages.

European Search Report for EP 09 17 9450, completed Jul. 23, 2010.

Flexyboots article, 2 pages.

Reebok Fall 2002 Footwear Catalog, p. 14, showing the U-Shuffle DMX shoe.

Reebok Third Quarter 2003 Footwear Catalog, p. 17, showing the Stimulus DMX shoe, and pp. 16 and 41, showing the Court Macabee II DMX shoe.

Reebok Spring 2005 Footwear Catalog, p. 30, showing the Sportcentric DMX Max shoe, p. 31, showing the Destination DMX shoe, and pp. 32 and 52, showing the Trail DMX Max and Sporterra DMX Walk shoes.

Reebok Third Quarter 2005 Footwear Catalog, p. 50, showing the Sportcentric DMX Max shoe.

Reebok First Quarter 2007 Footwear Catalog, pp. 16 and 53, showing the Voyage Mid III and Voyage Low III shoes.

The Times, Body + Soul article, p. 7-8, Sep. 26, 2009.

* cited by examiner

TRAINING FOOTWEAR

CROSS-REFERENCE TO RELATED APPLICATION

This application is a continuation of U.S. patent application Ser. No. 13/829,695, filed Mar. 14, 2013; which is a divisional of U.S. patent application Ser. No. 12/571,327, filed Sep. 30, 2009; which is a continuation-in-part of U.S. patent application Ser. No. 12/416,698, filed Apr. 1, 2009, each of which is incorporated by reference herein in its entirety.

BACKGROUND OF THE INVENTION

1. Field of the Invention

Embodiments of the present invention generally relate to footwear, and more particularly relate to exercise related footwear.

2. Background of the Invention

Most designers of modern athletic shoes strive to make a shoe which is both stable and provides adequate cushioning to the wearer. While this endeavor has led to some successful footwear products, there is a need for an athletic shoe which actually enhances a workout.

It is popular for weightlifters to use "free weights" because the athlete must not only lift the weight but also uses other muscles to stabilize the weights at the same time. This provides for a superior workout because more muscle groups are being utilized. This same principle is recognized in the use of exercise balls. However, there is a need for footwear products which employ some of these same principles. Specifically, there is a need for footwear which have a sole geometry and material selection which allow a wearer to obtain a better workout by purposefully introducing multidimensional micro-instabilities, or "controlled instabilities" into the shoe. The wearer uses his or her muscles for stability thereby obtaining a better workout and a workout which utilizes different muscles than are normally used with a traditional shoe. The use of dynamic balancing in footwear is intended to give the wearer a better workout.

The goal of providing a better workout cannot replace the need for safety. Thus, there is a need for footwear which is comfortable, is safe and provides a better workout.

The human foot is a complex and remarkable piece of machinery, capable of withstanding and dissipating many impact forces. The natural padding of fat at the heel and forefoot, as well as the flexibility of the arch, help to cushion the foot.

An athlete's stride is partly the result of energy which is stored in the flexible tissues of the foot. For example, a typical gait cycle for running or walking begins with a "heel strike" and ends with a "toe-off". During the gait cycle, the main distribution of threes on the foot begins adjacent to the lateral side of the heel (outside of the foot) during the "heel strike" phase of the gait, then moves toward the center axis of the foot in the arch area, and then moves to the medial side of the forefoot area (inside of the foot) during "toe-off". During a typical walking or running stride, the Achilles tendon and the arch stretch and contract, storing and releasing energy in the tendons and ligaments. When the restrictive pressure on these elements is released, the stored energy is also released, thereby reducing the burden which must be assumed by the muscles.

Although the human foot possesses natural cushioning and rebounding characteristics, the foot alone is incapable of effectively overcoming many of the forces encountered during athletic activity. Unless an individual is wearing shoes which provide proper cushioning and support, the soreness and fatigue associated with athletic activity is more acute, and its onset accelerated. The discomfort for the wearer that results may diminish the incentive for further athletic activity. Equally important, inadequately cushioned footwear can lead to injuries such as blisters, muscle, tendon and ligament damage, and bone stress fractures. Improper footwear can also lead to other ailments, including back pain. One need is for footwear which both provides protection as well as controlled instability in multiple directions.

Proper footwear should complement the natural functionality of the foot, in part, by incorporating a sole (typically including an outsole, midsole and insole) which absorbs shocks. However, the sole should also possess enough resiliency to prevent the sole from being "mushy" or "collapsing," thereby unduly draining the stored energy of the wearer.

In light of the above, numerous attempts have been made to incorporate into a shoe improved cushioning and resiliency. For example, attempts have been made to enhance the natural resiliency and energy return of the foot by providing shoes with soles which store energy during compression and return energy during expansion. These attempts have included the formation of shoe soles that include springs, gels or foams such as ethylene vinyl acetate (EVA) or polyurethane (PU). However, all of these tend to either break down over time or do not provide adequate cushioning characteristics.

Another concept practiced in the footwear industry to improve cushioning and energy return has been the use of fluid-filled systems within shoe soles. These devices attempt to enhance cushioning and energy return by transferring a pressurized fluid between the heel and forefoot areas of a shoe. The basic concept of these devices is to have cushions containing pressurized fluid disposed adjacent the heel and forefoot areas of a shoe.

While wearing footwear with appropriate cushioning and support can help to minimize injuries, individuals can further limit injuries and improve their overall physical conditioning by participating in a regular exercise program. There are many activities in daily life that require individuals to use their strength, agility, and balance, and maintaining physical fitness can help individuals complete these activities with minimum disruption to their lives. Maintaining physical fitness has also been shown to strengthen the heart, boost HDL cholesterol, aid the circulatory system, and lower blood pressure and blood fats, translating to lower risk for heart disease, heart attack, and stroke. Exercise also strengthens muscles, increases flexibility, and promotes stronger bones, which can help prevent osteoporosis.

In today's society, many individuals struggle to maintain basic levels of fitness. Time is one of the main roadblocks to maintaining a consistent training program, both for the elite athlete and the individual straggling to maintain physical fitness. There is an ever-increasing amount of demand on a person's free time.

In response to these concerns, over the years companies have developed various forms of exercise equipment and training programs designed to maximize the efficiency of an individual's training. The equipment and programs often achieve the desired result—reducing the amount of time investment necessary to maintain physical fitness. However, these methods still require an individual to allocate a block of time out of the individual's schedule for a workout.

Thus, there is a need for a training aid that allows a user to incorporate a workout into his or her daily routine while minimizing the time investment required.

BRIEF SUMMARY OF THE INVENTION

An article of footwear is presented. In one aspect of the present invention, an article of footwear includes a sole having a forefoot portion, a heel portion, an outsole having a bottom surface including a primary ground contacting surface, a midsole, and an intermediate sole disposed between the midsole and the outsole. The forefoot portion of the sole includes a toe area and a plurality of flex grooves in the toe area. At least a portion of the intermediate sole extends downwardly from said midsole such that the bottom surface of the outsole has a forefoot bulge and a heel bulge. The forefoot bulge may covers a portion of a forefoot portion of the primary ground contacting surface rearward of the toe area and the heel bulge substantially covers a heel portion of the primary ground contacting surface.

In another aspect of the present invention, an article of footwear has a sole having a midsole, a forefoot portion, a heel portion, and a bottom surface including a ground contacting surface, the midsole having a midsole rim, a heel core portion, and a forefoot core portion. The midsole rim includes a top surface, a bottom surface, a heel opening and a forefoot opening. The heel and forefoot core portions each have a volume and a convex bottom surface. Only a portion of the volume of each of the heel and forefoot core portions is disposed in the respective heel and forefoot openings of the midsole rim. A remaining portion of the volume of each of the heel and forefoot core portions extends below the bottom surface of the midsole rim such that a forefoot bulge corresponding with the convex bottom surface of the forefoot core portion substantially covers the forefoot portion of the ground contacting surface and a heel bulge corresponding with the convex bottom surface of the heel core portion substantially covers the heel portion of the ground contacting surface.

In another aspect of the present invention, an article of footwear has a sole including an outsole having a bottom surface, a midsole having a bottom surface including a plurality of cavities, and an intermediate sole disposed between the midsole and the outsole. The intermediate sole may have a resilient insert having a forefoot portion and a heel portion. The resilient insert may include at least one forefoot compressible chamber and a plurality of heel compressible chambers. The plurality of cavities of the midsole bottom surface correspond with the chambers of the resilient insert. The plurality of cavities accommodate a first portion of a volume of the chambers of the resilient insert. A second portion of the volume of the chambers of the resilient insert extends outside of the cavities in the midsole such that the bottom surface of the outsole has bulges that correspond with the chambers of the resilient insert.

BRIEF DESCRIPTION OF THE DRAWINGS/FIGURES

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE INVENTION

Figure 1:
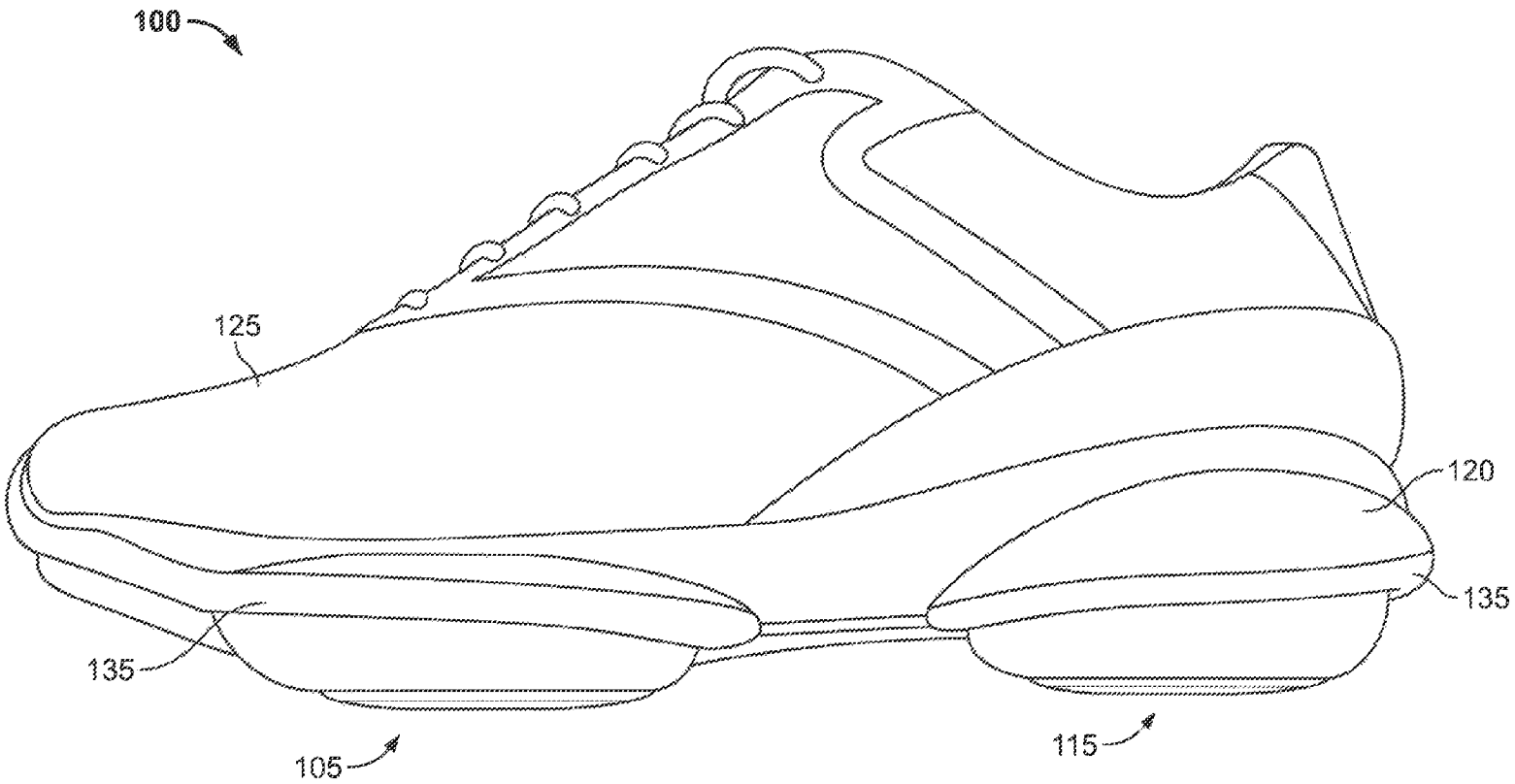
FIG. 1 is a lateral side view of a shoe according to an embodiment of the present invention.

The present invention will now be described in detail with reference to embodiments thereof as illustrated in the accompanying drawings, in which like reference numerals are used to indicate identical or functionally similar elements. References to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described. Also in the Figures, the left most digit of each reference numeral corresponds to the Figure in which the reference numeral first appears.

The following examples are illustrative, but not limiting, of the present invention. Other suitable modifications and adaptations of the variety of conditions and parameters normally encountered in the field, and which would be apparent to those skilled in the art, are within the spirit and scope of the invention.

Referring to the drawings and in particular to FIG. 1, an exemplary embodiment of an article of footwear, in particular a shoe, according to the present invention generally referred to by reference numeral 100 is shown. Although the article of footwear 100 may be referred to herein as shoe 100, it is contemplated that it may comprise any type of footwear in which the sole of the present invention may be desirable, including, but not limited to, walking shoes, running shoes, basketball shoes, court shoes, tennis shoes, training shoes, boots, and sandals.

The shoe 100 has a forefoot portion 105 and a heel portion 115, and includes an upper 125, a midsole 120, intermediate sole 130 (not shown in FIG. 1) and an outsole 135. In one embodiment of the present invention, an insole and/or sockliner may also be included within the shoe 100. In some embodiments, the midsole 120 may include the insole and/or sockliner. The outsole 135 may comprise a wear-resistant material. For example, outsole 135 can include synthetic or natural rubber, thermoplastic polyurethane (TPU), a wear-resistant foam, or a combination thereof. The midsole 120 may comprise a foam such as, for example, ethylene vinyl acetate (EVA) or polyurethane. In some embodiments, the midsole can include a molded thermoplastic component such as, for example, an injection molded TPU component. In one specific embodiment, the midsole is substantially composed of a molded thermoplastic such as, for example, an injection molded TPU. Alternatively, the materials comprising the outsole 135 and the midsole 120 may be chosen as deemed fit by one of skill in the art.

Figure 2:
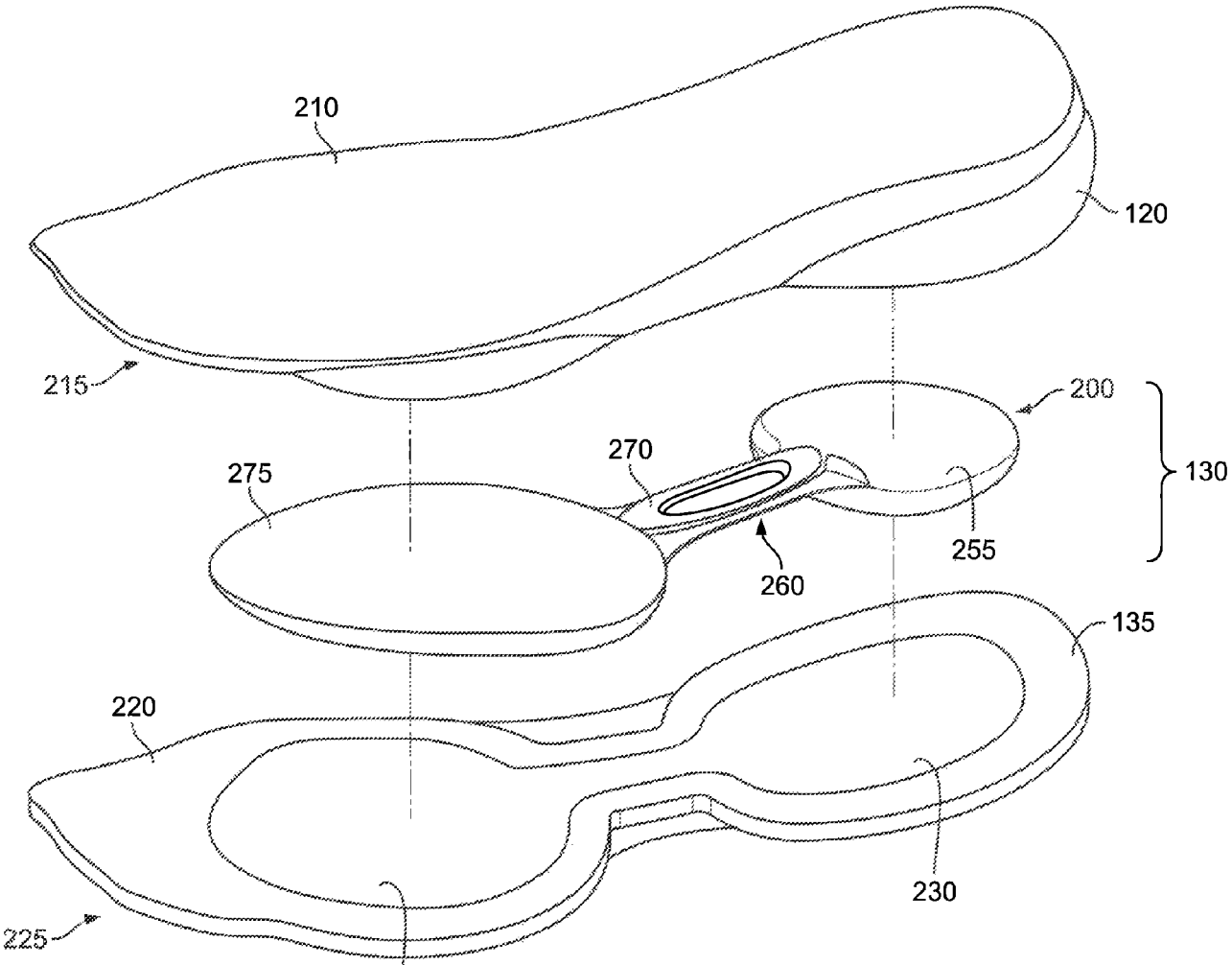
FIG. 2 is an exploded view of a midsole, intermediate sole, and outsole according to an embodiment of the present invention.
Figure 6:
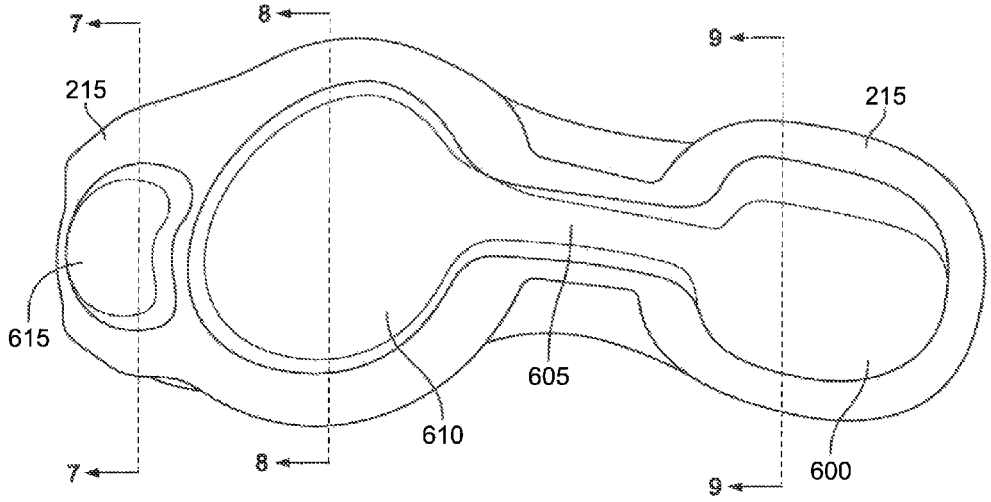
FIG. 6 is a bottom plan view of a midsole according to an embodiment of the present invention.
Figure 7:
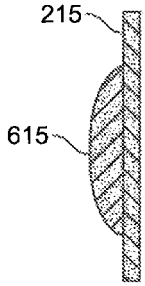
FIG. 7 is a cross-sectional view of the midsole taken along the line 7-7 in FIG. 6 according to an embodiment of the present invention.
Figure 8:
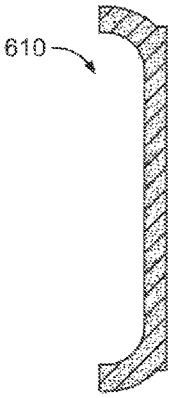
FIG. 8 is a cross-sectional view of the midsole taken along the line 8-8 in FIG. 6 according to an embodiment of the present invention.
Figure 9:
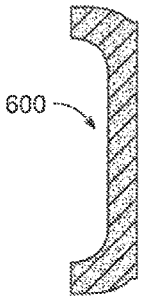
FIG. 9 is a cross-sectional view of the midsole of the present invention taken along the line 9-9 in FIG. 6 according to an embodiment of the present invention.

With reference to FIG. 2, in one embodiment of the present invention a sole includes the midsole 120, the outsole 135, and the intermediate sole 130. In one embodiment, the intermediate sole 130 comprises a resilient insert 200. The midsole 120 has a top surface 210 and a bottom surface 215. A heel cavity 600 and a forefoot cavity 610 are formed in the bottom surface of the midsole 120, as shown in FIGS. 6, 8, and 9. Similarly, the outsole 135 has a bottom surface 225 and a top surface 220 in which are formed a heel cavity 230 and a forefoot cavity 240. The midsole and outsole cavities are formed to accommodate the resilient insert 200 when the sole is assembled. To form the sole construction shown in FIG. 1, the top and sides of resilient insert 200 may be secured in the midsole and/or outsole cavities, for example, by a bonding adhesive. Suitable bonding adhesives include water-based adhesives and solvent-based adhesives such as, for example, urethane adhesives and ethylene vinyl acetate adhesives. The top surface 220 of the outsole 135 is then secured to the bottom surface 215 of midsole 120, for example, by using the same or a similar bonding adhesive. In addition, the bottom of resilient insert 200 may be secured to the top surface 220 of the outsole 135 using a bonding adhesive.

The intermediate sole 130 comprises a structure disposed between midsole 120 and outsole 135. In one embodiment of the present invention, the intermediate sole 130 comprises a resilient insert 200. As used herein, the term "insert" is not intended to be limiting. For example, in some embodiments of the present invention, the resilient insert 200 may be permanently placed in the shoe 100 during manufacturing and not separable therefrom. In certain embodiments, resilient insert 200 can be an integral part of midsole 120 or outsole 135. For example, midsole 120 or outsole 135 can be molded having resilient insert 120 integral therewith.

Figure 10:
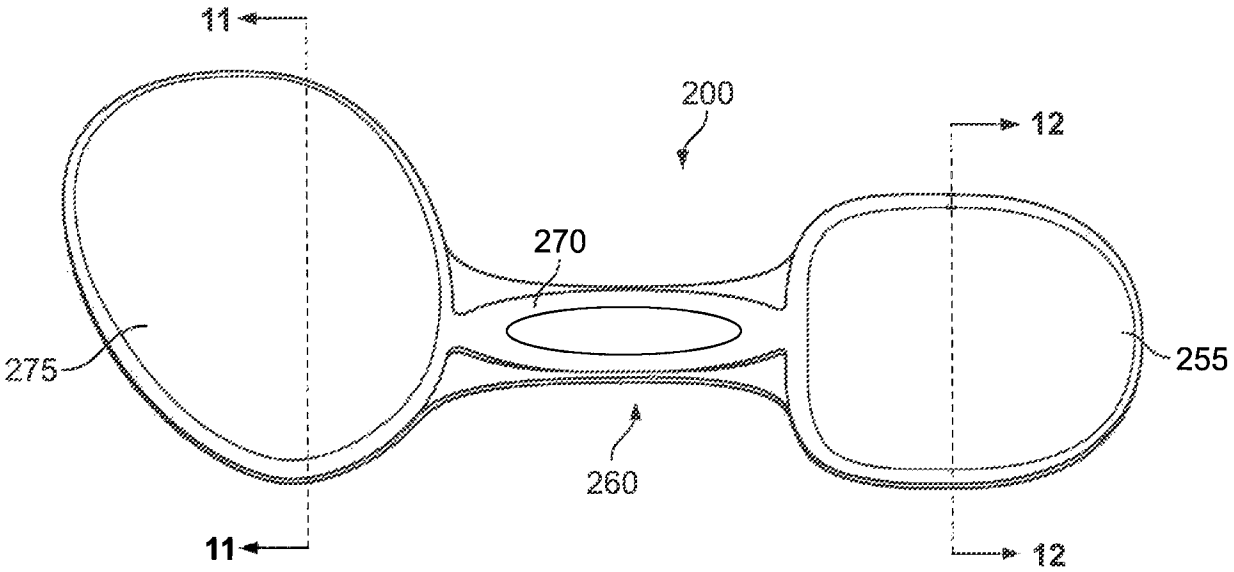
FIG. 10 is a top plan view of an intermediate sole according to an embodiment of the present invention.
Figure 11:
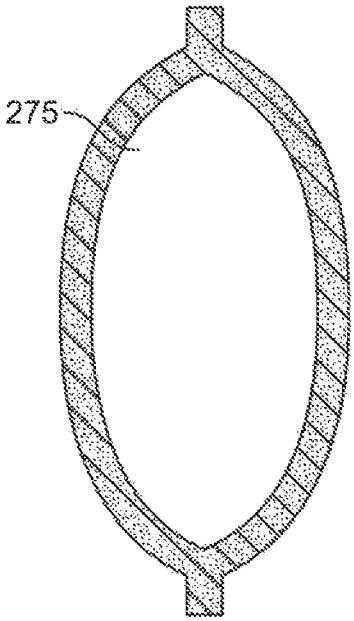
FIG. 11 is a cross-sectional view of the intermediate sole of the present invention taken along the line 11-11 in FIG. 10 according to an embodiment of the present invention.
Figure 12:
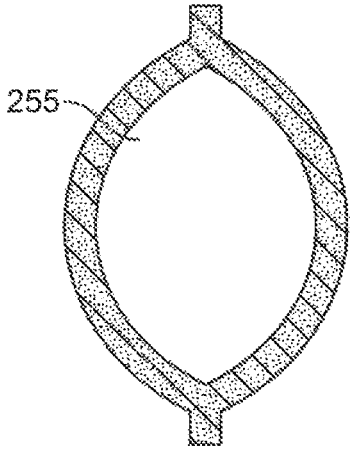
FIG. 12 is a cross-sectional view of the intermediate sole of the present invention taken along the line 12-12 in FIG. 10 according to an embodiment of the present invention.
Figure 13:
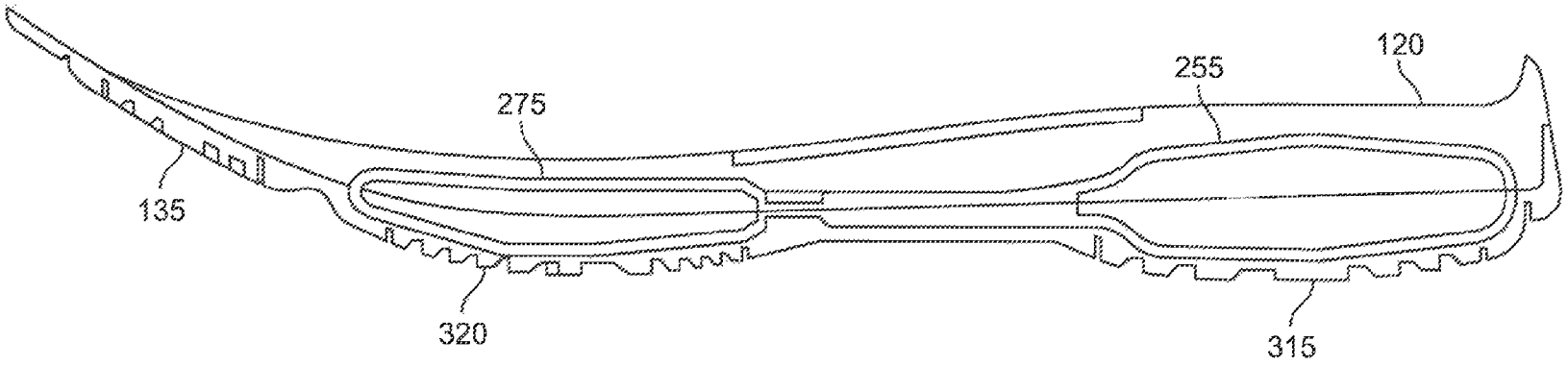
FIG. 13 is a cross-sectional view of an article of footwear according to an embodiment of the present invention.
Figure 14:
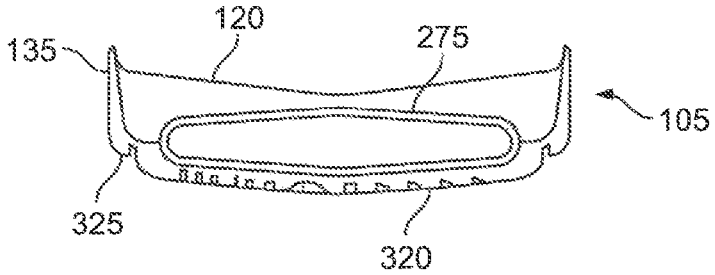
FIG. 14 is a cross-sectional view of the article of footwear taken along the line 14-14 in FIG. 3 according to an embodiment of the present invention.
Figure 15:
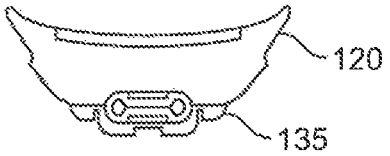
FIG. 15 is a cross-sectional view of the article of footwear taken along the line 15-15 in FIG. 3 according to an embodiment of the present invention.
Figure 16:
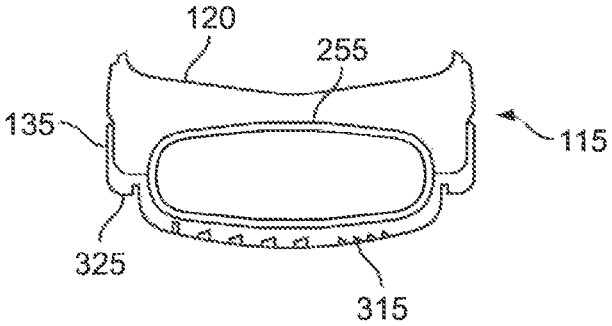
FIG. 16 is a cross-sectional view of the article of footwear taken along the line 16-16 in FIG. 3 according to an embodiment of the present invention.

In one embodiment of the present invention, with reference to FIGS. 2 and 10, the resilient insert 200 comprises a top surface 245 and a bottom surface 250. Together, the top and bottom surfaces generally define at least one heel chamber 255, at least one forefoot chamber 275, and a passageway 260. In some instances, as illustrated in FIGS. 2 and 10, the top and bottom surfaces generally define a single heel chamber 255, a single forefoot chamber 275, and a passageway 260. In one embodiment, the top and bottom as well as the sides of resilient insert 200 may be mirror images of one another and, in light of its symmetrical nature, resilient insert 200 may be incorporated in either a left or right shoe by merely turning the resilient insert over to its reverse side.

With continuing reference to FIGS. 2 and 10, passageway 260 fluidly connects heel chamber 255 to forefoot chamber 275 to permit a contained material (e.g., a fluid, a gel, a paste, or flowable particles) to flow between the chambers in response to forces applied to the bottom of the wearer's foot.

In one embodiment, the resilient insert shown in FIGS. 2 and 10 may comprise a structure similar to that disclosed in U.S. Pat. No. 6,745,499 to Christensen, et al., incorporated herein in its entirety by reference. Resilient insert 200 provides continuous cushioning to the wearer's foot, such that a wearer's stride forces a material (e.g., a fluid, a gel, a paste, or flowable particles) within the resilient insert to flow in a manner complementary with respect to the wearer's stride and the application of forces to the anatomical structure of the foot. Resilient insert 200 can be formed of a suitably resilient material so that it can compress with the application of force and expand with the delivery of a material (e.g., a fluid, a gel, a paste, or flowable particles), while also resisting breakdown.

In one embodiment, passageway 260 may comprise an impedance structure 270 which acts as a regulator to control the flow of a material as it flows from one chamber to the other. While impedance structure 270 is shown with a specific construction in the figures, it should be understood that other impedance structures could be utilized in resilient insert 200, including those disclosed in International Patent Publication No. PCT/US94/00895 by Reebok International Ltd. and U.S. Pat. No. 5,771,606 to Litchfield, et al., the disclosures of which are incorporated herein in their entirety by reference thereto.

It should be understood that alternate resilient insert constructions can be used in practice of the present invention. In one embodiment, the resilient insert includes at least two discrete pieces (e.g., discrete fluid, gel, paste, or particle-containing chambers), at least one first discrete piece being housed in a forefoot cavity and at least one second discrete piece being housed in a heel cavity. In such embodiments, the at least two discrete pieces are not in fluid communication with each other. In other embodiments, resilient insert includes at least two chambers in fluid communication with each other and also at least one discrete piece that is not in fluid communication either with another discrete piece or with the at least two chambers.

Resilient insert 200 can be formed of a polymer such as an elastomer and can be formed using any of various molding techniques known in the art. For example, resilient insert 200 can be blow molded, such as by injection blow molding or stretch blow molding. Further, other manufacturing methods can be used to form resilient insert 200, such as thermoforming and sealing, injection molding and sealing, vacuum forming and sealing or radio frequency (RF)/high frequency (HF) welding. In some instances, an aperture is used to fill the resilient insert with a fluid (e.g., a liquid or a gas such as ambient or pressurized air at a pressure greater than ambient air); a gel; a paste, particles (e.g., polymer particles, foam particles, cellulose particles, rock or mineral particles, rubber particles, and the like), or a combination thereof. In some instances, the resilient insert contains air or other suitable gases at a pressure greater than ambient air.

In some instances, the resilient insert includes a fluid-filled bladder. In other instances, the resilient insert is a fluid-filled bladder. The bladder may be filled with a gas such as, for example, pressurized or non-pressurized (ambient) air. Fluid filled bladders suitable for use in footwear include, but are not limited to, bladders like those described in U.S. Pat. No. 7,395,617 to Christensen, et al. and U.S. Pat. No. 7,340,851 to Litchfield, et al., the disclosures of which are incorporated herein in their entirety by reference.

In some embodiments, resilient insert 200 can be customized to suit the wearer, either by the retailer or manufacturer or by the wearer. For example, pressure of a fluid within the resilient insert can be altered according to a wearer's preference such as to achieve a desired shoe feel or performance. By altering the pressure within the resilient insert, a wearer can alter stability of the shoe and, thereby, the exertion level for the wearer or the muscle activity required of the wearer.

In some embodiments, an inflation system, such as an air pump and release mechanism, can be used to alter the pressure of a fluid within the resilient insert. Examples of an inflation system suitable for use with the resilient insert include inflation systems having pumps actuated by the pressure exerted by a wearer's foot, pumps actuated by a wearer's hand, electronically actuated pumps, and automatically actuated pumps. In addition, inflation systems can contain one or more of the following: valves, one-way valves, release valves, pressure regulators, manifolds, conduit, pressure transducers, automated or electronic control systems, power sources, air inlets, and pressurized gas sources.

In other embodiments, the resilient insert includes at least two chambers in fluid communication and a valve to prevent or restrict flow of a material (e.g., a fluid, a gel, a paste, or particles) between the chambers. A user can alter the position of the valve to achieve a desired shoe feel or performance. Alternatively, the valve can be electronically actuated or automatically actuated.

Alternate materials could also be used to form intermediate sole 130. For example, intermediate sole 130 can also be formed of a visco-elastic material, EVA, polyurethane foam, or any other material such as silicone or cast urethane. Intermediate sole 130 can be formed of a single piece of material or multiple discrete pieces, may be formed with or without material in the arch region of the sole, and may be solid, porous, or hollow. In some embodiments, the intermediate sole 130 can be formed of discrete pieces of material, layers of materials, structured materials (e.g., honeycomb structured materials), or a combination thereof. Components of the intermediate sole 130 can be formed by various techniques known in the art such as, for example, die cutting, compression molding, injection molding, and blow molding.

In one embodiment, intermediate sole 130 may further comprise a fluid-filled bladder. The bladder may be filled with a gas such as, for example, pressurized or non-pressurized (ambient) air. The bladder may operate similar to the resilient insert such that a wearer's stride forces air within the bladder to flow in a manner complementary with respect to the wearer's stride and the application of forces to the anatomical structure to the foot. In some embodiments, the bladder can be customized to suit the wearer, either by the retailer or manufacturer or by the wearer. Accordingly, the intermediate sole can contain a fluid control or an inflation system for use with a bladder, such as those described supra for use with a resilient insert.

Figure 19:
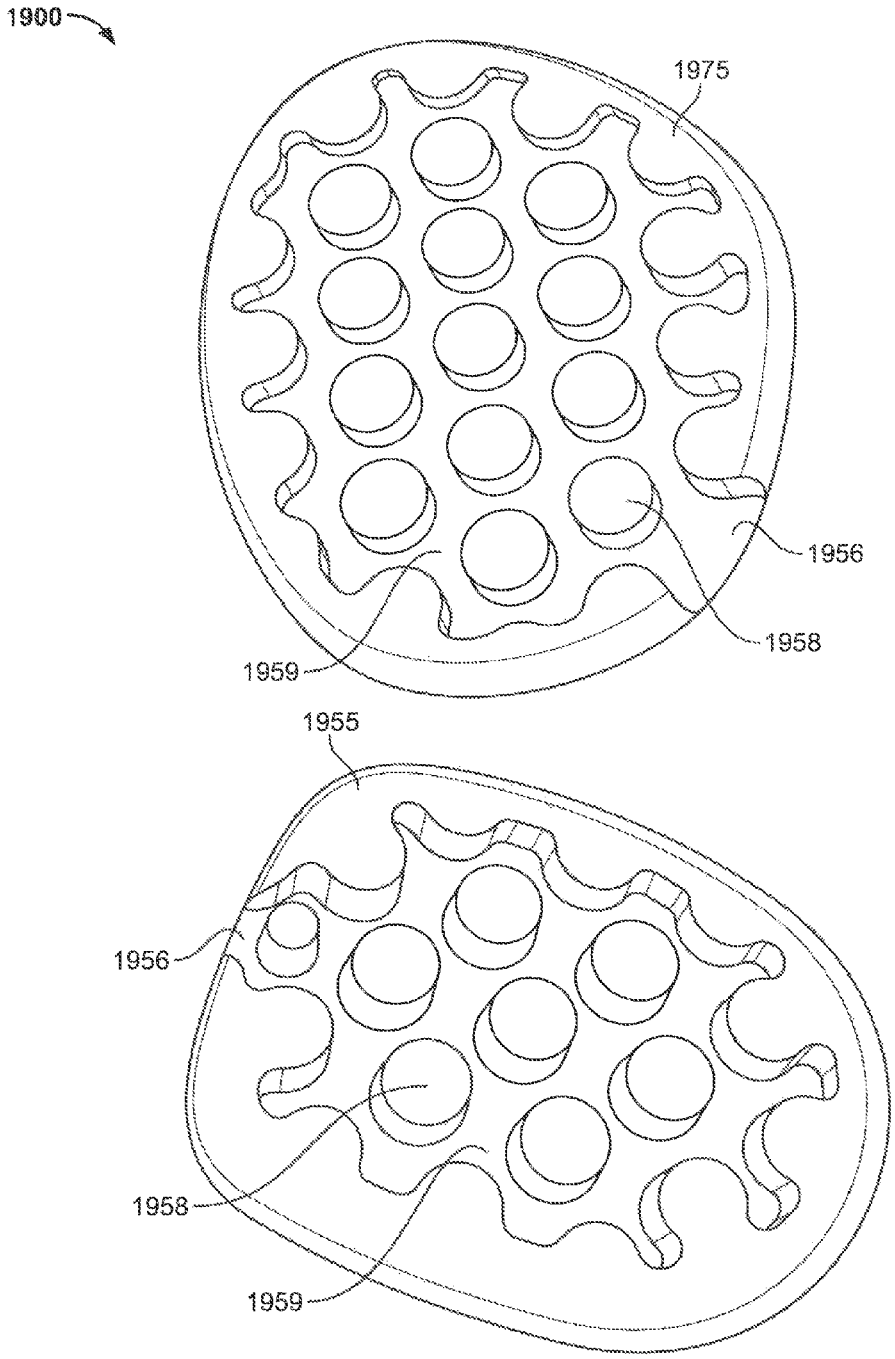
FIG. 19 is a perspective view of an intermediate sole according to an embodiment of the present invention.

In an alternative embodiment, intermediate sole 130 may comprise a foam or a foam insert having one or more different physical properties (e.g., density) than those of midsole 120. For example, intermediate sole 130 can include polyurethane foam, EVA foam, an open-celled foam, a closed-cell foam, or a reticulated foam having different physical properties than those of midsole 120. In certain preferred embodiments, intermediate sole 130 includes a foam through which fluid, such as air, can flow from forefoot to heel and from heel to forefoot. For example, intermediate sole 130 can include an open-celled foam or a foam with longitudinal fluid channels therein. In one embodiment, shown in FIG. 19, intermediate sole 130 comprises a foam insert 1900 having forefoot and heel portions 1975 and 1955, respectively. Grooves in a bottom surface of foam insert 1900 form longitudinal fluid passages 1959 in forefoot and heel portions 1975 and 1955 that meander between foam pillars 1958 that outline passages 1959. Fluid can enter passages 1959 of forefoot and heel portions 1975 and 1955 via an inlet/outlet 1956. Forefoot and heel portions 1975 and 1955 may be separate pieces, as shown, or connected with a fluid passageway so that fluid can flow from forefoot to heel and from heel to forefoot. In alternative embodiments, the grooves forming passages 1959 are provided on a top surface of foam insert 1900 or on both the top and bottom surfaces of foam insert 1900.

Figure 3:
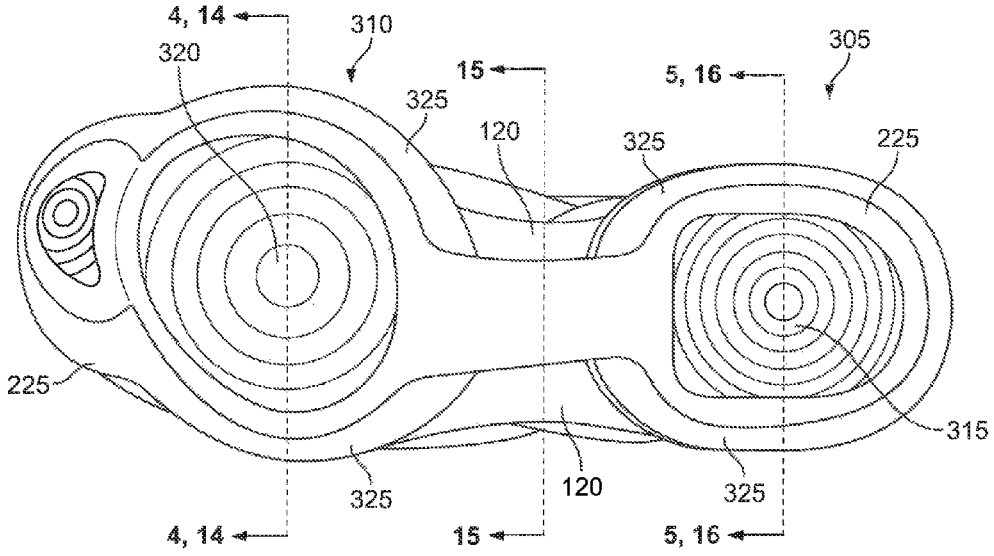
FIG. 3 is a bottom plan view of an article of footwear according to an embodiment of the present invention.
Figure 4:
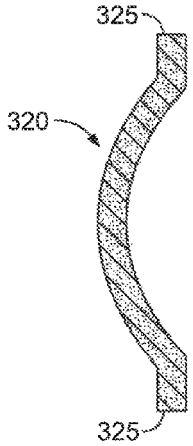
FIG. 4 is a cross-sectional view of the outsole taken along the line 4-4 in FIG. 3 according to an embodiment of the present invention.
Figure 5:
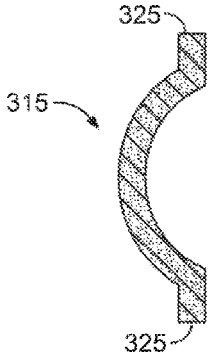
FIG. 5 is a cross-sectional view of the outsole taken along the line 5-5 in FIG. 3 according to an embodiment of the present invention.

With reference to FIGS. 3, 4, and 5, outsole 135 comprises the part of the footwear that makes contact with the ground, and may be formed of a wear-resistant rubber or foam material. In one embodiment, outsole 135 may also be made from a clear crystalline rubber material so that intermediate sole 130 is visible to the wearer through outsole 135. As would be apparent to one of skill in the art, outsole 135 may be formed with tread patterns such as grooves, indentations, or cleats on bottom surface 225. In some embodiments, such tread patterns can enhance traction or enhance muscle activity of a wearer such as by increasing the intermediate sole's resistance to compression.

In some embodiments, outsole 135 includes a primary ground contacting surface and a secondary ground contacting surface. As that term is used herein, primary ground contacting surface means the portion(s) of a shoe sole in contact with a level ground surface during an average natural gait cycle. The primary ground contacting surface generally corresponds to regions of the sole lying under the heel and under the metatarsal heads. "Secondary ground contacting surface," as that term is used herein, means the portion(s) of a shoe sole that may occasionally make contact with a ground surface during an average natural gait cycle or that may regularly make contact with a ground surface during an atypical gait cycle.

Outsole 135 has a heel portion 305 and a forefoot portion 310. A generally flat perimeter 325 can extend inward from the edge of outsole around both the heel and forefoot portions. The perimeter 325 may be substantially flat so as to create a platform surface. Although, in some embodiments (not illustrated), outsole does not include a flat perimeter such as perimeter 325. Bottom surface 225 can include at least one heel bulge 315 corresponding to at least one heel cavity 230 and at least one forefoot bulge 320 corresponding to at least one forefoot cavity 240. In one specific embodiment, bottom surface 225 includes only one heel bulge 315 corresponding to only one heel cavity 230 and only one forefoot bulge 320 corresponding to only one forefoot cavity 240. In each of these embodiments, these convex bulges can extend away from the flat perimeter 325. These bulges have a curved shape, and each bulge reaches its maximum vertical displacement from perimeter 325 at a point that lies generally in the center of the bulge. In one embodiment, bulges 315 and 320 reach maximum vertical displacement from perimeter 325 at a point that lies generally on the longitudinal axis of the shoe. In one embodiment, the vertical displacement between flat perimeter 325 and bulges 315 and 320 increases from flat perimeter 325 to the longitudinal axis of the shoe. In a heel to toe direction, the vertical displacement may increase from the rear and forward perimeter of each bulge to the center of each bulge.

In embodiments of the present invention including a primary ground contacting surface and a secondary ground contacting surface, the forefoot portion of the primary ground contacting surface may include the outsole covering bulge 320 and a portion of the edge of outsole 135 and perimeter 325. The heel portion of the primary ground contacting surface may include the outsole covering bulge 315 and a portion of the edge of outsole 135 and perimeter 325. The forefoot portion of the secondary ground contacting surface may include at least a portion of the edge of outsole 135 and perimeter 325, which may extend from the edge to the forefoot bulge about the perimeter of the forefoot portion. The heel portion of the primary ground contacting surface may include at least a portion of the edge of outsole 135 and perimeter 325, which may extend from the edge to the heel bulge about the perimeter of the heel portion.

In one embodiment, an article of footwear includes a sole having a forefoot portion and a heel portion, the sole comprising a midsole, an intermediate sole, and a primary ground contacting surface, wherein at least a portion of the intermediate sole extends from the midsole such that a forefoot bulge substantially covers the forefoot portion of the primary ground contacting surface and a heel bulge substantially covers the heel portion of the primary ground contacting surface. The article of footwear can further comprise a secondary ground contacting surface. In some embodiments, the forefoot portion of the secondary ground contacting surface comprises an edge and a platform surface extending from the edge to the forefoot bulge about the perimeter of the forefoot portion, wherein the platform surface is substantially flat relative to the forefoot bulge. In some embodiments, the heel portion of the secondary ground contacting surface comprises an edge and a platform surface extending from the edge to the heel bulge about the perimeter of the heel portion, wherein the platform surface is substantially flat relative to the heel bulge. In yet other embodiments, the forefoot portion of the secondary ground contacting surface comprises an edge and a platform surface extending from the edge to the forefoot bulge about the perimeter of the forefoot portion, wherein the platform surface is flat relative to the forefoot bulge, and the heel portion of the secondary ground contacting surface comprises an edge and a platform surface extending from the edge to the heel bulge about the perimeter of the heel portion, wherein the platform surface is substantially flat relative to the heel bulge.

The generally convex shape and steady curvature of heel bulge 315 and forefoot bulge 320, together with the resiliency provided by intermediate sole 130 may create a controlled rocking motion, or instability, during the gait cycle in both a medial to lateral direction and a heel to toe direction. The wearer's body may work to stabilize the gait, and by forcing the wearer's body to do so, the shoe may trigger increased training to the muscles such as those muscles in the wearer's calves, thighs, lower back, buttocks, and/or abdomen.

An embodiment of a midsole for use in the article of footwear is shown in FIGS. 6 through 9. Midsole 120 may comprise any suitable midsole material, including, but not limited to, a foam such as ethylene vinyl acetate (EVA) or polyurethane. In some embodiments, the midsole can include a molded thermoplastic component such as, for example, an injection molded TPU component. Midsole 120 may be molded using known techniques including, but not limited to, die cutting, injection molding, compression molding, and open pouring.

In the embodiment illustrated in FIGS. 6 through 9, midsole 120 comprises a contoured cushioning layer that is structured to provide a support base for cradling afoot on its top surface 210 and receiving intermediate sole 130 on its bottom surface 215. As shown in FIG. 6, the bottom surface of the midsole includes heel cavity 600, passageway cavity 605, and forefoot cavity 610 formed therein. A raised portion 615 extends from the forefoot to cover a portion of the toe region. Cavities 600, 605, and 610 are sized to receive a portion of intermediate sole 130. However, cavities 600, 605, and 610 could be formed in different shapes and/or depths depending on the size and shape of the intermediate sole 130. Further, midsole 120 could be formed without passageway cavity 605 and/or raised portion 615. The midsole may also include a cavity to house a shank or arch stiffener, not shown.

Cavities 600 and 610 are formed such that they do not accommodate all of intermediate sole 130. In embodiments of the present invention which include perimeter 325, intermediate sole 130 may extend beyond the level of the perimeter surface. In one embodiment, intermediate sole 130 extends beyond the level of the perimeter 325 by at least about 2 millimeters, such as by at least about 5 millimeters. In embodiments of the present invention which include resilient insert 200, cavities 600 and 610 are formed such that they do not accommodate the entire volume of heel chamber 255 and forefoot chamber 275.

The depth of the cavities permits the resilient insert to be "pre-loaded" in the shoe during the typical gait phase of a wearer's motion. More particularly, because heel and forefoot chambers 255 and 275 of resilient insert 200 extend convexly beyond the opening of the midsole cavities 600 and 610, chambers 255 and 275 may receive impact forces before the shoe makes full contact with the ground (or the wearer's heel strikes the heel of the midsole). As a result, the fluid transfer process between heel and forefoot chambers of resilient insert 200 is initiated or advanced before a force is fully applied to the shoe sole to ensure that a sufficient amount of fluidic cushioning and support is provided to the foot of the wearer at all stages of the gait cycle.

The depth of cavities 600 and 610 and the presence of the intermediate sole therein can aid in maintaining the shape of heel and forefoot bulges 315 and 320 in the outsole. Because a portion of heel and forefoot chambers 255 and 275 of resilient insert 200 are thus housed in the heel and forefoot cavities 230 and 240 of the outsole, bulges 315 and 320 can maintain at least some curvature during the gait cycle. As discussed above, when curvature is maintained in outsole bulges 315 and 320 via the intermediate sole, a wearer's muscles may be forced to exert themselves more strenuously, or different muscles can be activated, to stabilize the gait. By adjusting the volume of resilient insert 200 that is accommodated in midsole cavities 600 and 610, it is possible to change the amount and/or rate at which forefoot bulge 320 and heel bulge 315 collapse as force is applied to the sole.

It is thought that forming the sole such that heel and forefoot cavities 600 and 610 are more shallow, and thus accommodate a smaller proportion of the intermediate sole (e.g., resilient insert 200), can force a wearer's muscles to work to stabilize the gait.

In contrast, it is thought that forming the sole such that heel and forefoot cavities 600 and 610 are deeper, and thus accommodate a larger proportion of the intermediate sole, can provide more stability and thereby require less, or even no, work by the wearer's muscles to stabilize the gait.

Alternatively, by adjusting the volume of the intermediate sole (e.g., resilient insert 200) or the pressure within the intermediate sole, the volume or the firmness of the intermediate sole can be changed to affect the amount or type of muscle exertion needed to stabilize a wearer's gait. For example, the volume of a resilient insert or the pressure of air inside a resilient insert could be increased by inflating it with air, thereby increasing the volume of the resilient insert outside the midsole cavities or increasing the firmness of the resilient insert and thus changing the amount or type of muscle exertion needed to stabilize a wearer's gait. In some embodiments, the volume of a resilient insert or the pressure of air inside a resilient insert can be decreased to stabilize the shoe and the volume of a resilient insert or the pressure of air inside a resilient insert can be increased to create controlled instability in the shoe that the wearer compensates for by engaging their muscles.

In some embodiments of the present invention, heel cavity 600 is sized to accommodate no more than about 60% by volume of a heel portion of the intermediate sole (e.g., heel chamber 255 of resilient insert 200). In other embodiments, heel cavity 600 is sized to accommodate no more than about 50% by volume of a heel portion of the intermediate sole. For example, heel cavity 600 can be sized to accommodate about 40% to about 50% or about 45% to about 50% by volume of a heel portion of the intermediate sole.

Likewise, forefoot cavity 610 can be sized to accommodate no more than about 60% by volume of a forefoot portion of the intermediate sole (e.g., forefoot chamber 275 of resilient insert 200). In other embodiments, forefoot cavity 610 is sized to accommodate no more than about 50% by volume of a forefoot portion of the intermediate sole. For example, forefoot cavity 610 can be sized to accommodate about 40% to about 50% or about 45% to about 50% by volume of a forefoot portion of the intermediate sole.

In one particular embodiment, heel cavity 600 is sized to accommodate about 50% by volume of a heel portion of the intermediate sole (e.g., heel chamber 255 of resilient insert 200) and forefoot cavity 610 is sized to accommodate less than about 50% by volume of a forefoot portion of the intermediate sole.

The depth of cavities 600 and 610 may be modified to accommodate a greater or lesser volume of the intermediate sole without departing from the scope of the invention such that portions of the heel and forefoot chambers extend beyond the heel and forefoot cavities to provide the desired stability and corresponding exertion level for the wearer.

With reference to FIG. 3, intermediate sole 130 extends from midsole 120 such that heel bulge 315 substantially covers heel portion 305 of outsole 135 and forefoot bulge 320 substantially covers forefoot portion 310. In one embodiment, this may result in forefoot bulge 320 covering greater than about 30%, greater than about 50%, greater than about 75%, greater than about 90%, or substantially all of outsole forefoot portion 310 and heel bulge 315 covering greater than about 50%, greater than about 75%, greater than about 90%, or substantially all of outsole heel portion 305. It is contemplated that the size of bulges 320 and 315 may be modified to provide the desired stability and corresponding exertion level for the wearer.

The intermediate sole can extend from the midsole such that a heel bulge substantially covers a heel portion of a ground contacting surface (e.g., a primary ground contacting surface) and a forefoot bulge substantially covers a forefoot portion of a ground contacting surface (e.g., a primary ground contacting surface). In some embodiments, this may result in a forefoot bulge covering greater than about 50%, greater than about 75%, greater than about 90%, or substantially all of a forefoot portion of the ground contacting surface (e.g., a forefoot portion of a primary ground contacting surface) and a heel bulge covering greater than about 50%, greater than about 75%, greater than about 90%, or substantially all of a heel portion of the ground contacting surface (e.g., a heel portion of a primary ground contacting surface).

In some embodiments, an article of footwear includes a sole having a forefoot portion and a heel portion, the sole comprising a midsole, an intermediate sole, and a ground contacting surface a primary ground contacting surface), wherein at least a portion of the intermediate sole is disposed in the midsole and at least half of the intermediate sole extends from the midsole in the forefoot portion and the heel portion such that only one forefoot bulge is disposed in the forefoot portion of the ground contacting surface and only one heel bulge is disposed in the heel portion of the ground contacting surface. It is believed that embodiments of the present invention containing only one forefoot bulge and only one heel bulge can provide a characteristic wear feel, can increase the exertion required of the wearer, and/or can increase muscle activity of the wearer as compared to footwear containing multiple bulges disposed in either the forefoot or heel portion of the ground contacting surface due, in part, to the unstable ground contacting surface of such embodiments.

Figure 17A:
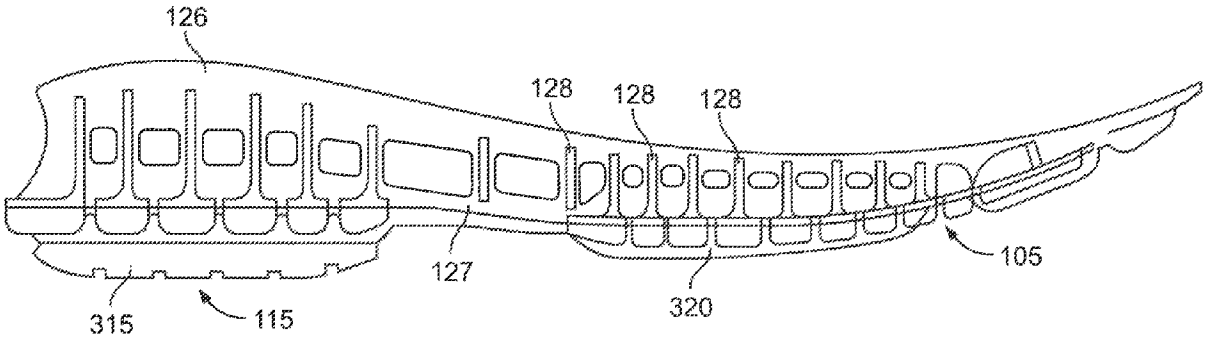
FIG. 17A is a medial side view of a skeletal support structure according to an embodiment of the present invention.
Figure 17B:
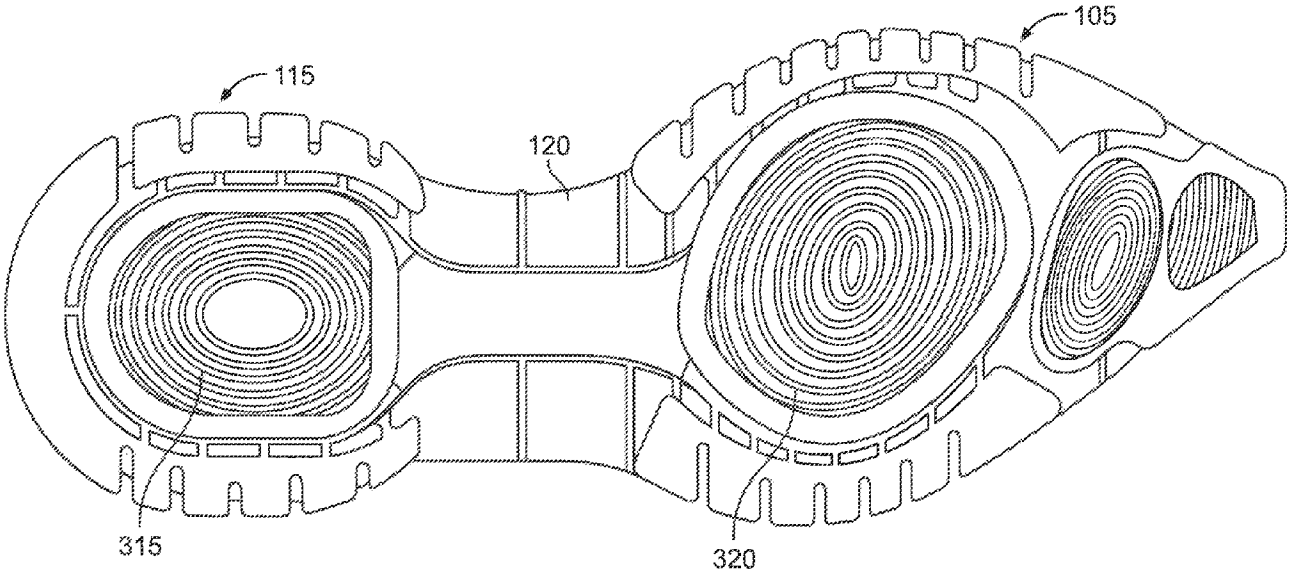
FIG. 17B is a bottom view of an outsole and midsole with a skeletal support structure according to an embodiment of the present invention.

With reference to FIGS. 17A and 17B, in one embodiment midsole 120 may comprise a skeletal support structure formed around the intermediate sole 130. The skeletal support structure may comprise a top plate 126 and a bottom plate 127, and a plurality of vertical supports 128 may extend between the top and bottom plates. Top plate 126 may be shaped to provide a support base for cradling a foot. The support structure may comprise TPU or other suitable material for providing support to the overall structure of the midsole. In one embodiment, top plate 126, bottom plate 127, and vertical supports 128 may be molded as a unitary piece. In alternative embodiments, one or more of the components may be molded separately. In one embodiment, midsole 120 may further comprise additional material, such as, for example, EVA foam in addition to the skeletal support structure to provide additional cushioning properties to the midsole.

Figure 18:
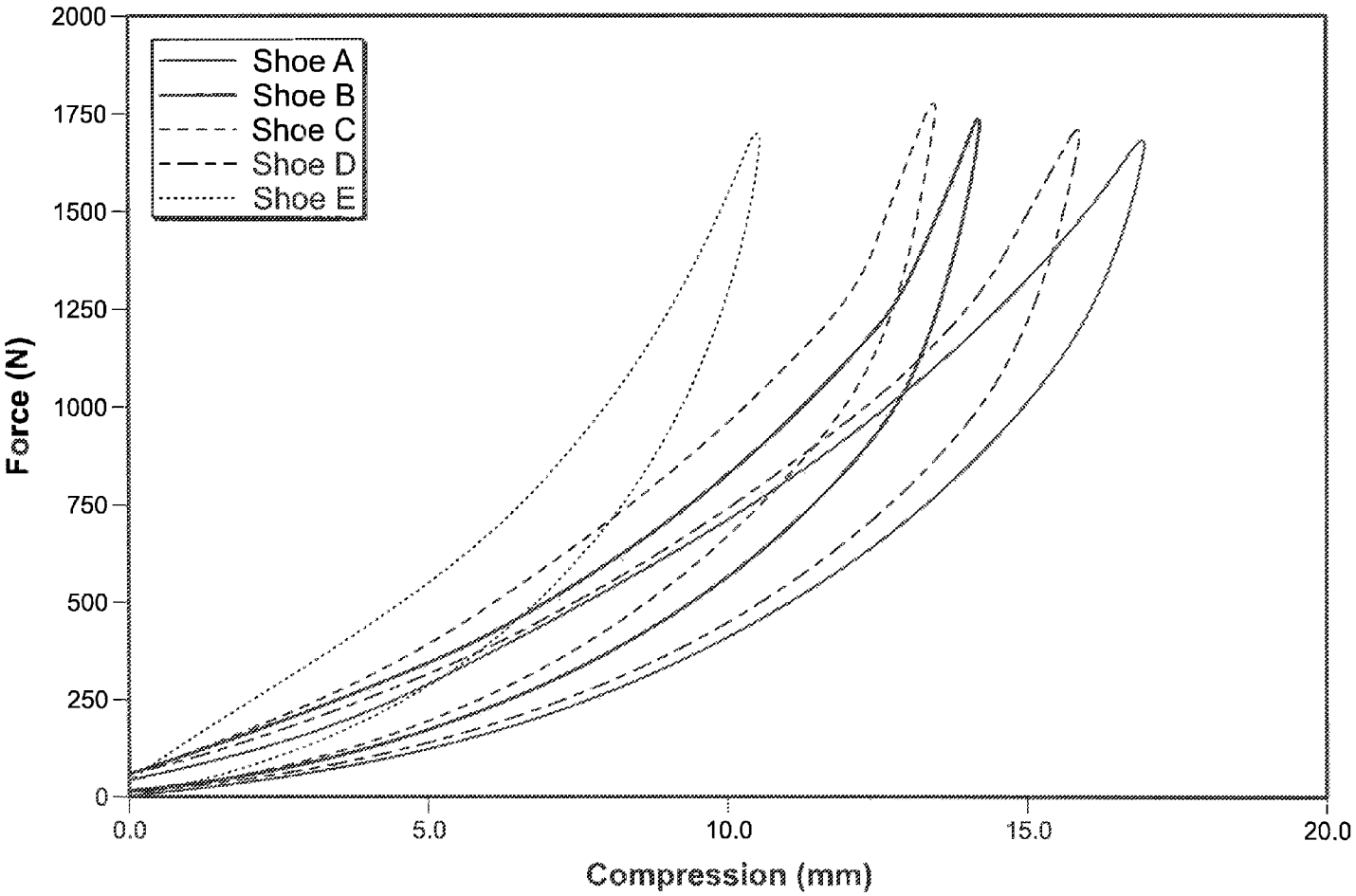
FIG. 18 is a chart depicting an exemplary force-compression curve of an article of footwear according to an embodiment of the present invention.

FIG. 18 is a chart depicting an exemplary heel region force-compression curve of an article of footwear according to an embodiment of the present invention. Shoes "A," "B," "C," and "D" each contain a resilient insert similar to that shown in FIG. 10. An embodiment of shoe "A" is depicted in FIGS. 1-9. Shoe "B" is the REEBOK® Voyage Low IV. Shoe "C" is the REEBOK® Versa Cushion DMX II. Shoe "D" is the REEBOK® Rainwalker VIII. Shoe E is the REEBOK® Express Walk R G, and does not contain a resilient insert. FIG. 18 illustrates that Shoe "A," which contains a similar resilient insert as Shoes "B"-"D," but which has a different midsole construction from those shoes, absorbed more energy during heel region force-compression testing. Accordingly, it is believed that the increased energy absorption of shoes of embodiments of the present invention, as embodied by Shoe "A." can provide a characteristic wear feel, can increase the exertion required of the wearer, and/or can increase muscle activity of the wearer.

As discussed above, intermediate sole 130 may comprise one or more of a variety of materials and constructions. By altering the hardness of intermediate sole 130, it is possible to change the rate at which forefoot bulge 320 and heel bulge 315 distort as force is applied to the sole. Using a relatively soft insert in intermediate sole 130 can cause the bulges to distort from their curved shape during walking or running, thereby providing more sole-to-ground contact. This may result in more stability and a less strenuous workout. In contrast, using a relatively firm insert can cause the bulges to retain their curved shape to a greater extent, and can force the wearer's muscles to exert themselves to stabilize the gait.

Figure 20:
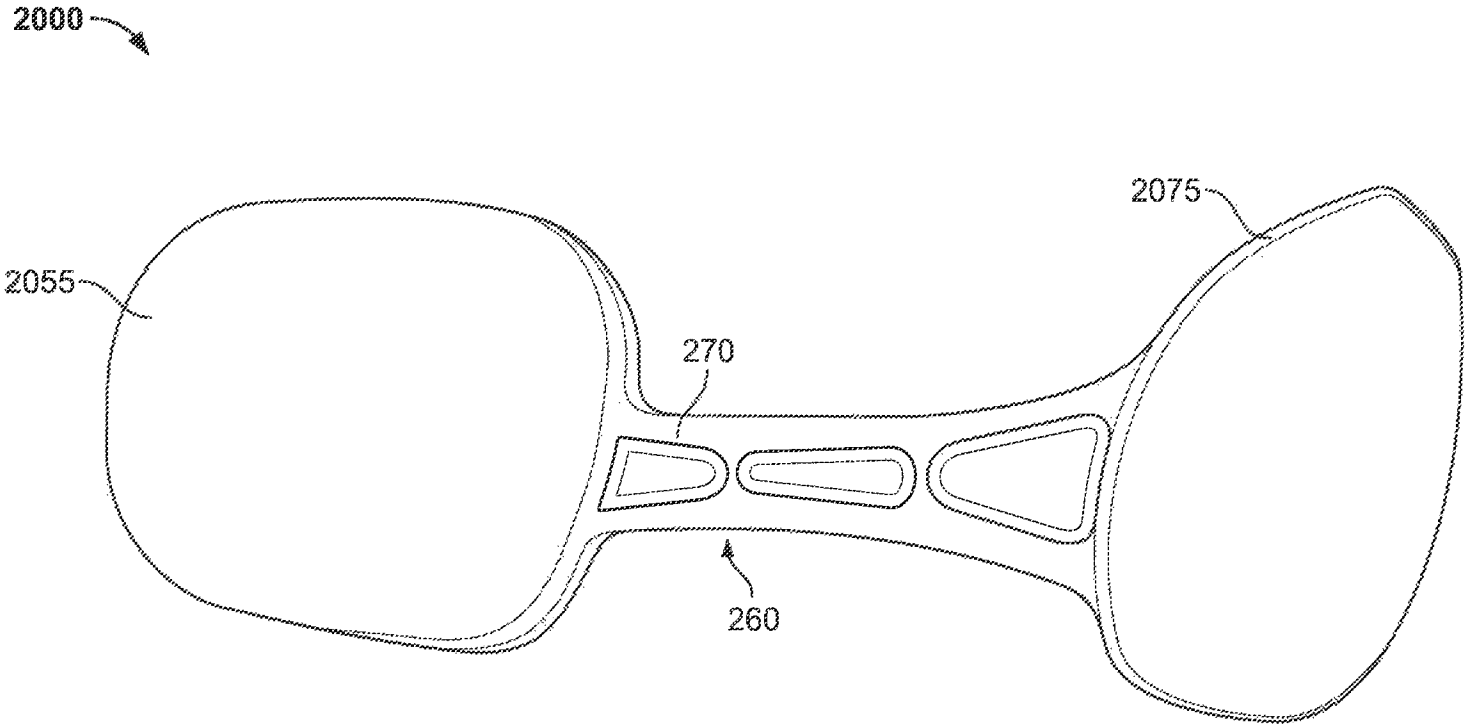
FIG. 20 is a perspective view of an intermediate sole according to an embodiment of the present invention.
Figure 21:
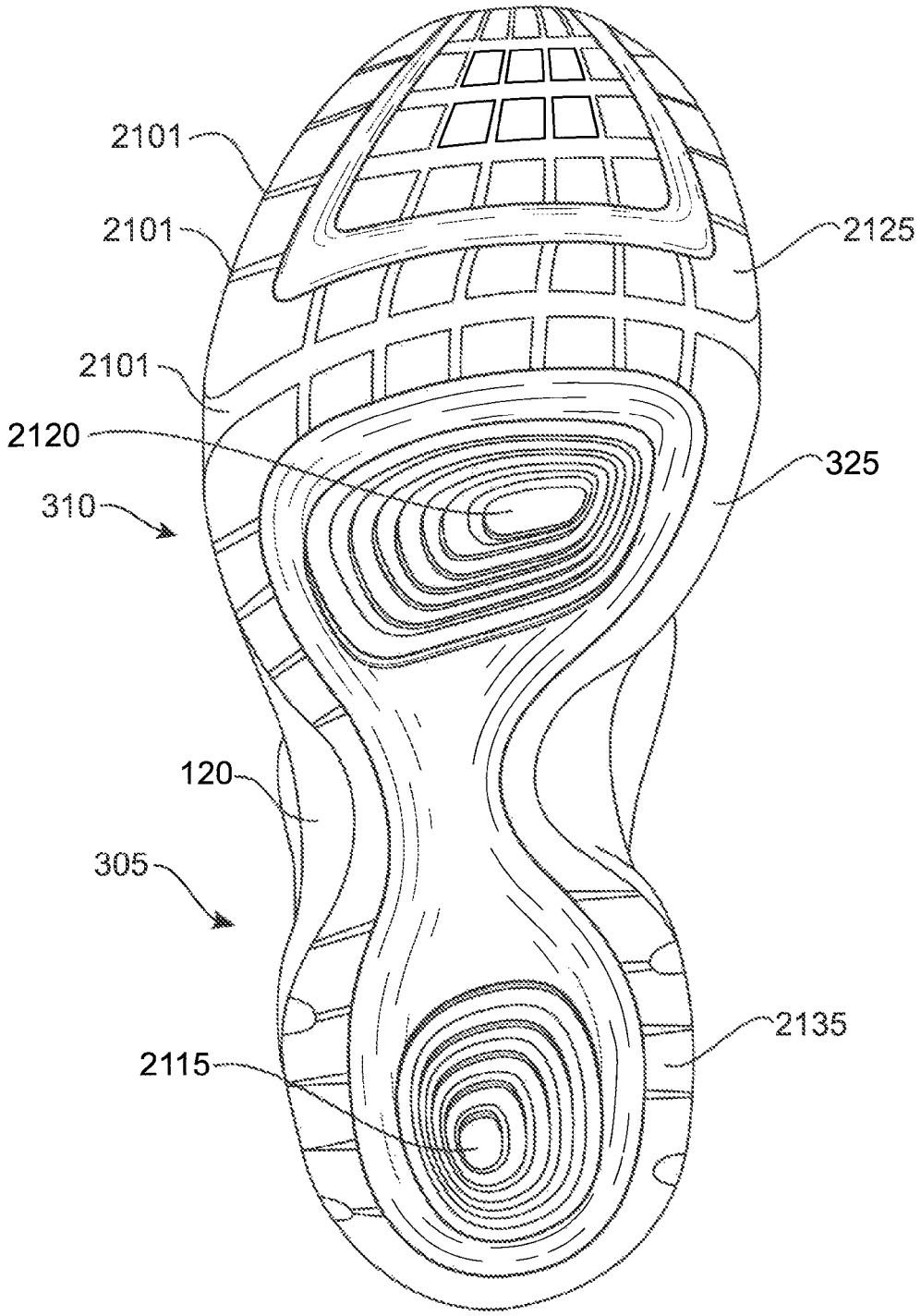
FIG. 21 is a bottom plan view of a shoe incorporating the intermediate sole of FIG. 20, according to an embodiment of the present invention.

The geometry of the heel and forefoot chambers of resilient insert 200 may also be varied such that the corresponding heel and forefoot bulges cover more or less of heel portion 305 and forefoot portion 310 of outsole 135, thereby covering more or less of a ground contacting surface. In one embodiment, shown in FIG. 20, intermediate sole 130 comprises a resilient insert 2000 having heel chamber 2055 and a forefoot chamber 2075. In contrast with forefoot chamber 275 of FIG. 2, forefoot chamber 2075 is shorter in the longitudinal direction of the sole so as to extend under the ball of a foot just forward of the arch. FIG. 21 shows a bottom plan view of a shoe sole incorporating resilient insert 2000. Heel cavity 600 and forefoot cavity 610 of midsole 120 are each dimensioned as described supra, for example, to accommodate about 40 to about 50% or about 50% by volume of heel chamber 2055 and forefoot chamber 2075, respectively. Thus, heel chamber 2055 and forefoot chamber 2075 extend beyond the heel and forefoot cavities, and a bottom surface 2025 of outsole 135 has corresponding heel bulge 2115 and forefoot bulge 2120 that extend downward from perimeter 2135. In preferred embodiments, heel bulge 2115 and forefoot bulge 2120 are generally convex. In some embodiments, the dimensions of heel chamber 2055 and a forefoot chamber 2075 can vary, and the dimensions of heel bulge 2115 and forefoot bulge 2120 can correspondingly vary. Perimeter 2135 can be substantially similar to perimeter 135 described supra, and in some embodiments, a width of perimeter 2135 can vary in correspondence with the dimensions of heel bulge 2115 and forefoot bulge 2120. In some embodiments, perimeter 2135 has a slight slope toward heel bulge 2115 and forefoot bulge 2120, a more aggressive tread, or both for better control during training activities.

Forefoot bulge 2120 of outsole 135 does not substantially cover forefoot portion 310, but rather is positioned rearward of a toe area 2122 of forefoot portion 310. Shortened forefoot bulge 2120 allows toe area 2122 to be provided with a plurality of flex grooves 2101 on bottom surface 2125 of outsole 135. Shortened forefoot bulge 2120 also can provide more flexibility in toe area 2122 due to the absence of an intermediate sole, such as a resilient insert, in the toe area. In this manner, the curvature of heel bulge 315 and forefoot bulge 2120 may create controlled instability, or rocking, in the longitudinal and lateral directions during the gait cycle, and flexibility of the sole is improved at the "toe-off" portion of the gait cycle. The wearer's body may work to balance the gait, such that the wearer's muscles compensate for the instability, and the wearer's calves, thighs, lower back, buttocks, and/or abdomen may be conditioned through dynamic balancing of the body during the gait cycle. This conditioning may be likened to the dynamic balancing and body conditioning that is achieved by performing exercises using a core or stability ball. Resilient insert 2000 may be, or may include, a soft foam, a gel, or a hollow blow molded part.

Figure 22A:
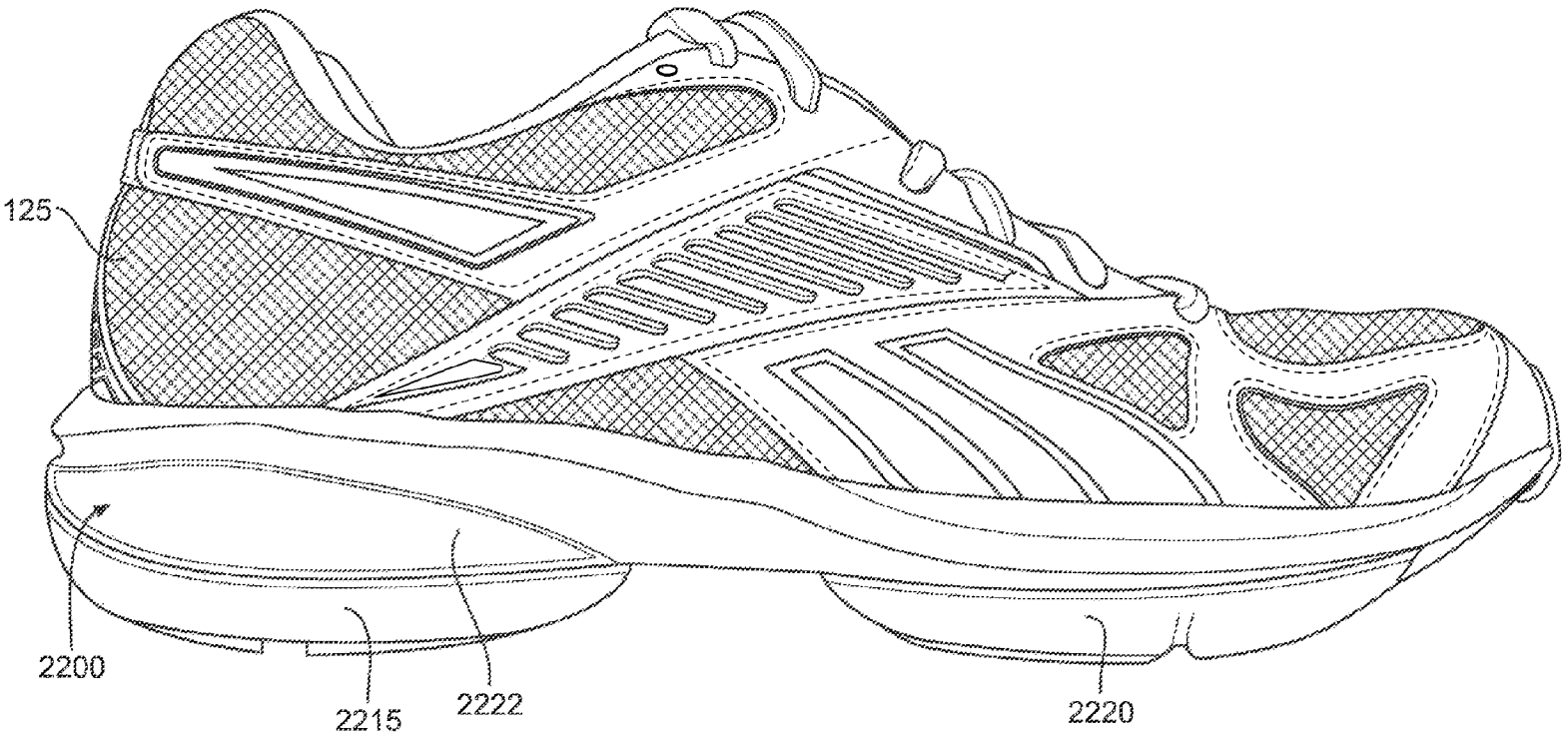
FIG. 22A is a side view of a shoe according to an embodiment of the present invention.
Figure 22B:
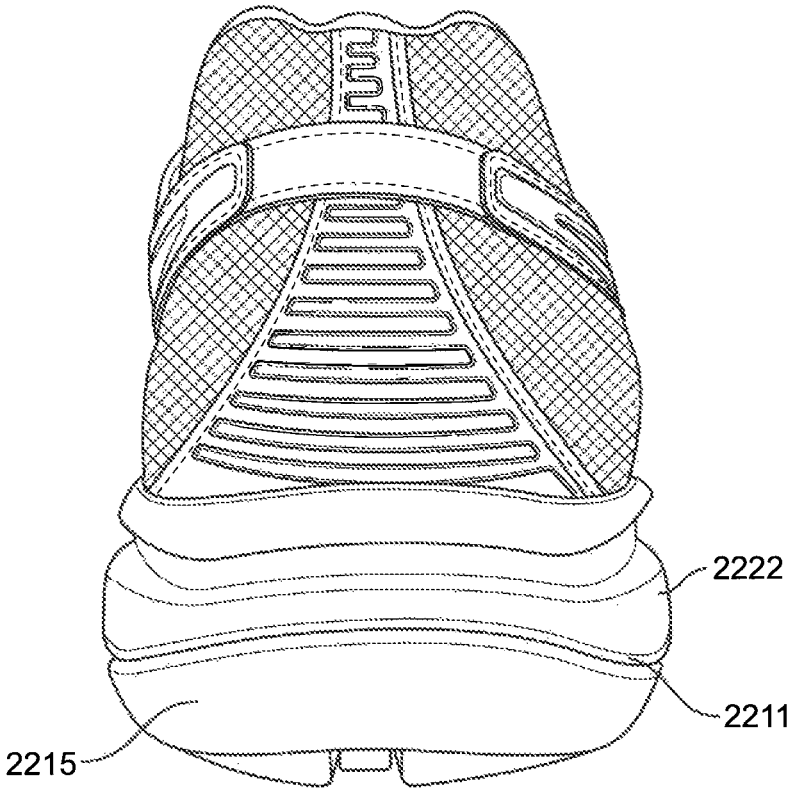
FIG. 22B is a rear view of the shoe of FIG. 22A.
Figure 22C:
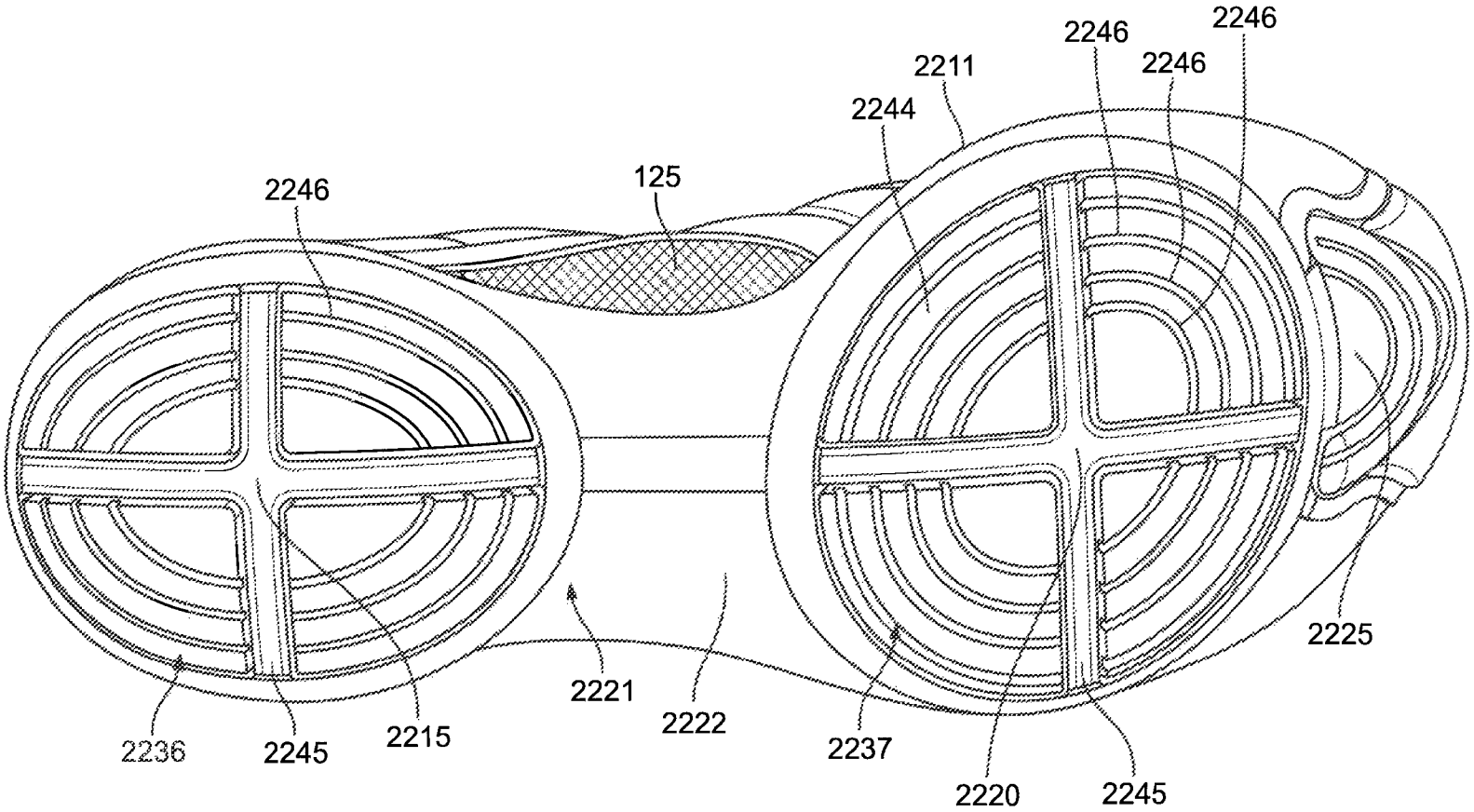
FIG. 22C is a bottom plan view of the shoe of FIG. 22A

Another embodiment of a footwear sole that may be incorporated into shoe 100 will now be described with reference to FIGS. 22A-C, and 23-27. As shown in FIGS. 22A-22C, connected to upper 125 is a sole 2200 having a midsole 2221 with a midsole rim 2222, a heel outsole 2236, a forefoot outsole 2237 which has a toe region 2225. Bottom surfaces of heel outsole 2236 and forefoot outsole 2237 have a heel bulge 2215 and forefoot bulge 2220. Heel and forefoot outsoles 2236 and 2237 can have a tread design 2244 that includes a large "+" shaped tread groove 2245 and circular grooves 2246 concentrically radiating from the center of the heel and forefoot bulges 2215 and 2220. In one embodiment, groove 2245 can be generally orthogonal lines that intersect at the center of the heel and forefoot bulges 2215 and 2220.

In the embodiment shown, heel and forefoot outsoles 2236 and 2237 do not include a flat perimeter such as perimeter 325 that forms a platform surface, however a flat perimeter may be included. Rather in the illustrated embodiment, heel bulge 2215 and forefoot bulge 2220 extend to an edge 2211 of the sole, with heel bulge 2215 covering substantially the entire bottom surface of heel outsole 2236 and forefoot bulge 2220 covering substantially the entire bottom surface of forefoot portion 2237. Heel and forefoot bulges 2215 and 2220 may have a pronounced convex shape to achieve controlled instability and that the wearer can correct during the gait cycle to balance and which may correspondingly condition the muscles. Further, with the flat platform being absent, the heel and forefoot bulges 2215 and 2220 substantially cover the bottom surfaces of respective heel outsole 2236 and forefoot outsole 2237 (e.g., both the primary and secondary ground contacting surfaces), which may further provide the shoe with an increased or smoother rocking movement in longitudinal and lateral directions during the gait cycle.

Figure 23:
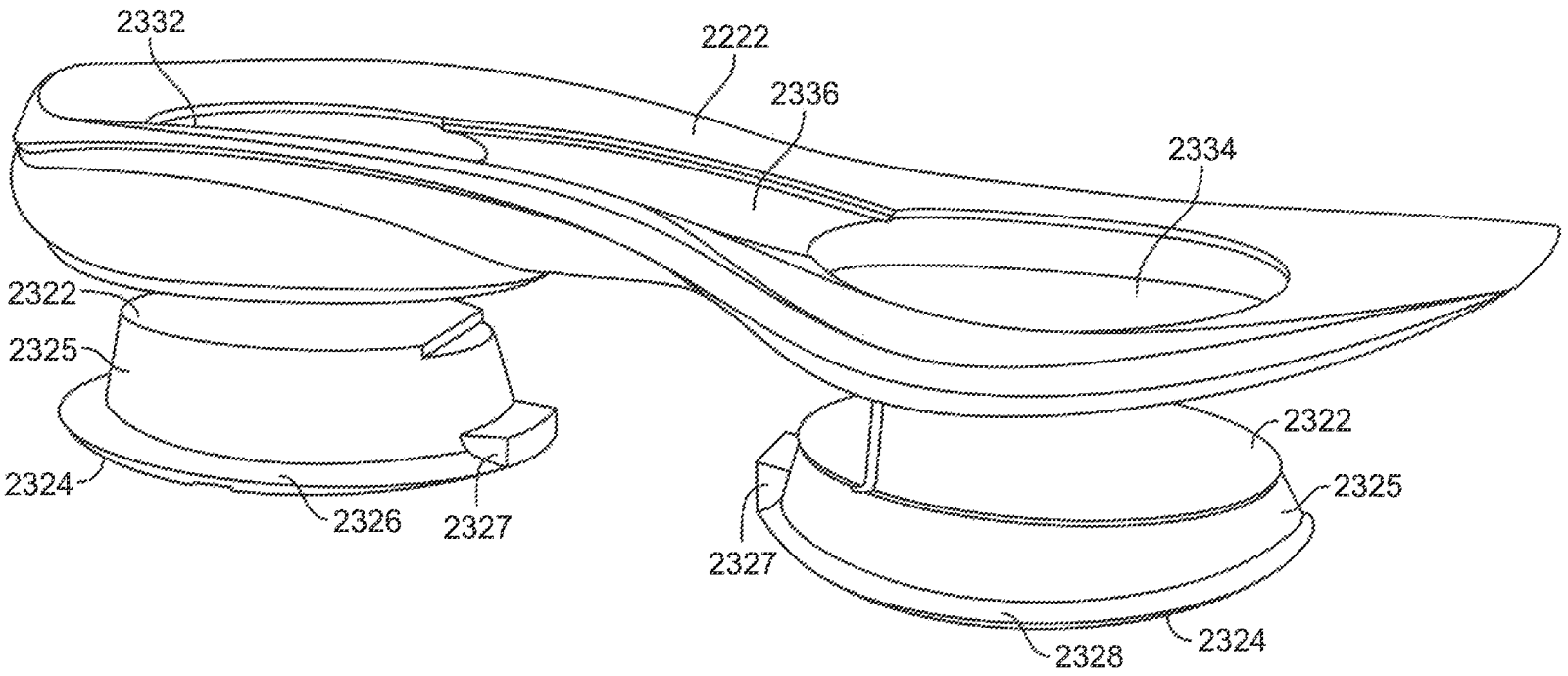
FIG. 23 is an exploded top perspective view of a midsole according to an embodiment of the present invention.
Figure 24:
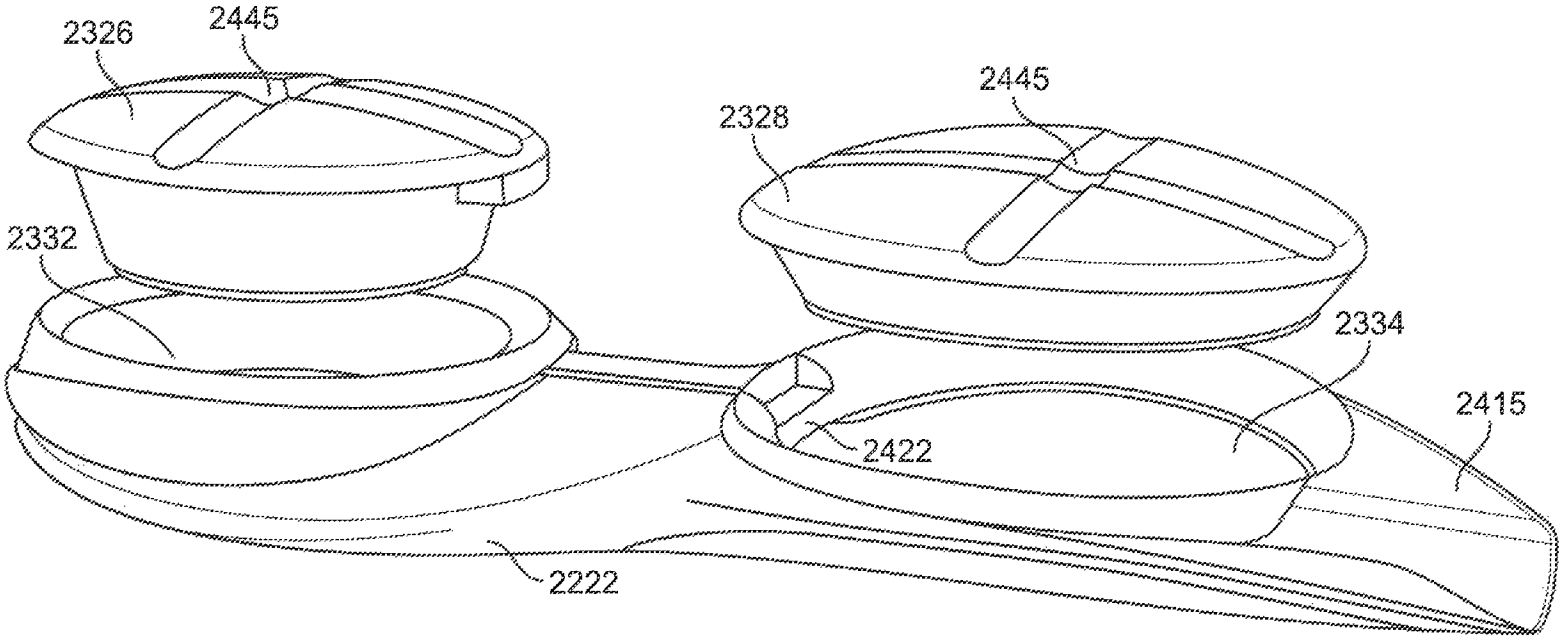
FIG. 24 is an exploded bottom perspective view of the midsole of FIG. 23.
Figure 25:
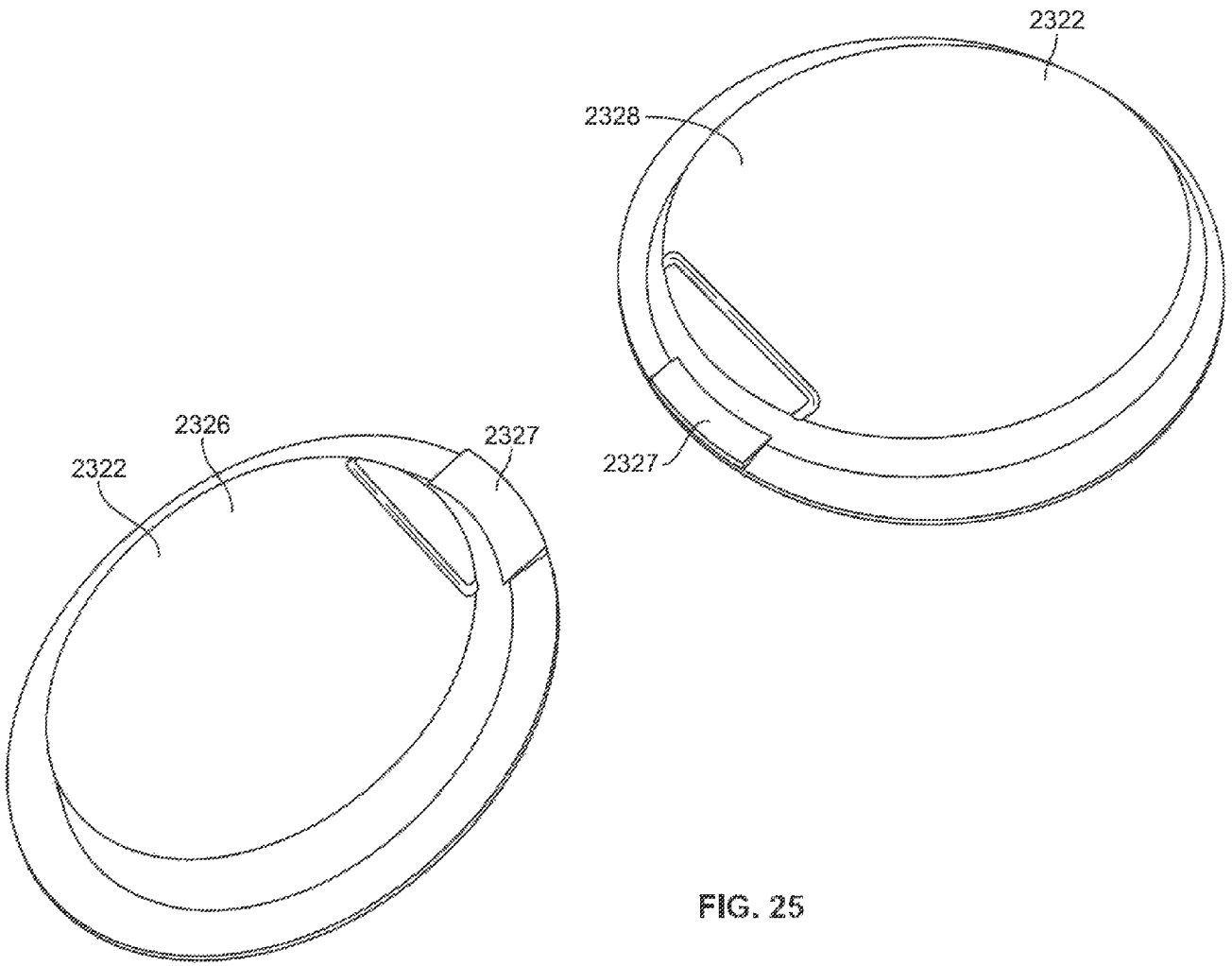
FIG. 25 is an exploded top perspective view of portions of the midsole of FIG. 23.
Figure 26:
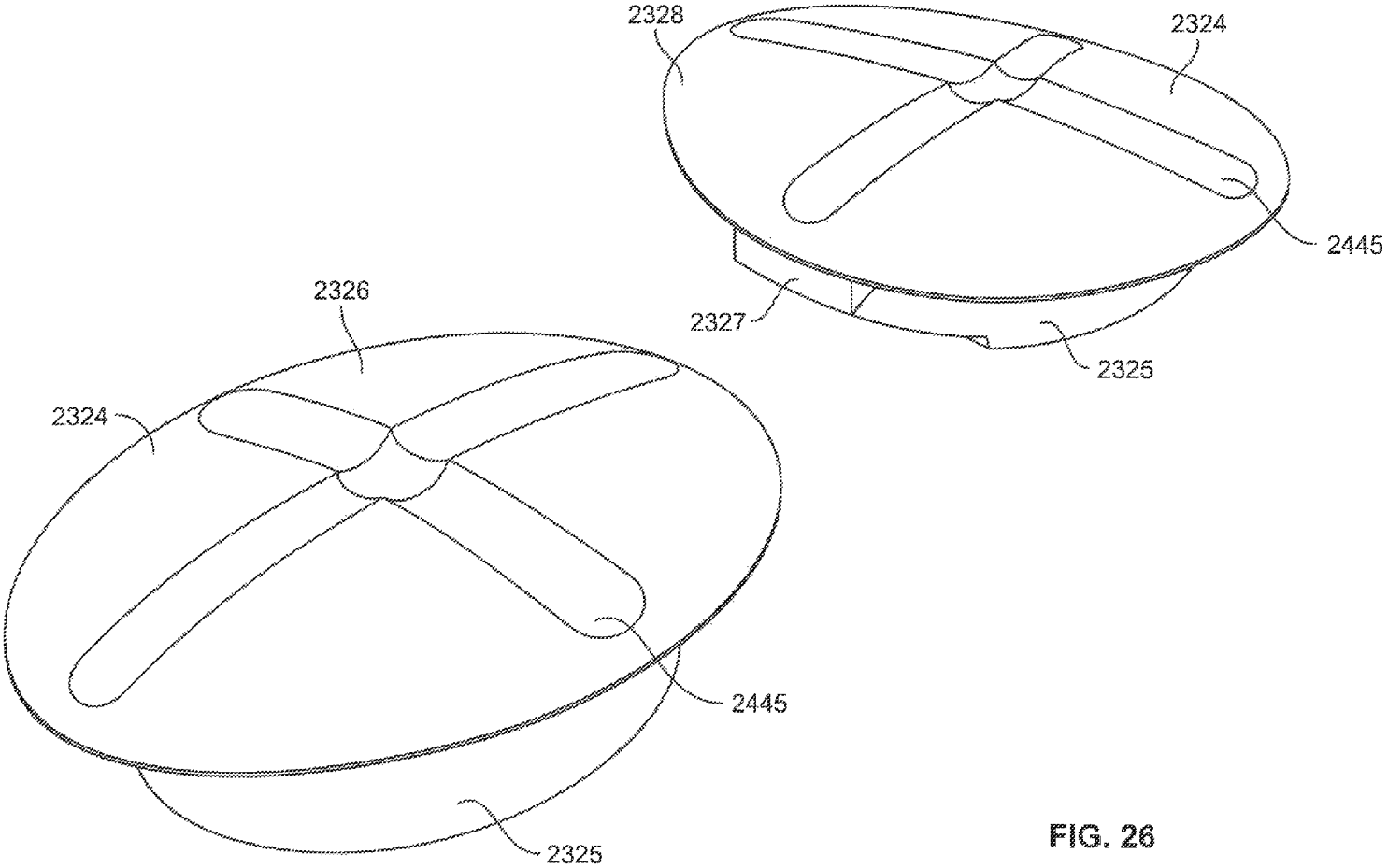
FIG. 26 is an exploded bottom perspective view of portions of the midsole of FIG. 23.
Figure 27:
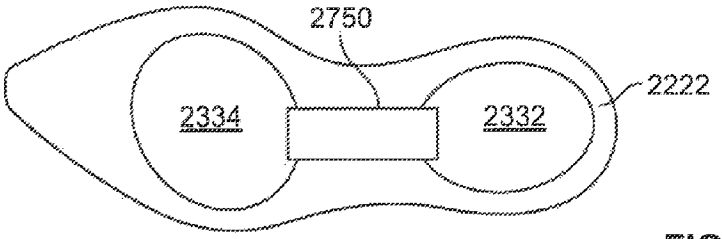
FIG. 27 is a top plan view of the midsole of FIG. 23.
Figure 28:
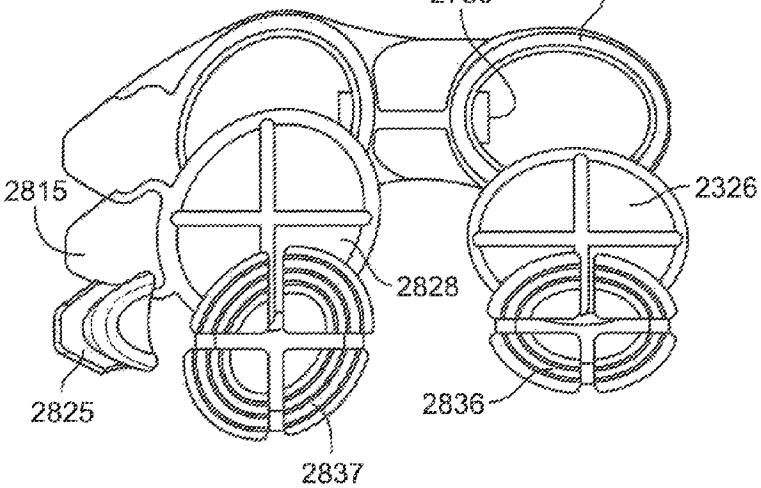
FIG. 28 is an exploded bottom view of a sole according to an embodiment of the present invention.

Heel bulge 2215 corresponds with a heel core portion 2326 of the midsole, and forefoot bulge 2220 corresponds with a forefoot core portion 2328 of the midsole, as shown in FIGS. 22-25. FIGS. 23 and 24 illustrate exploded top and bottom perspective views, respectively, of midsole having midsole rim 2222, a heel core portion 2326, and a forefoot core portion 2328. FIGS. 25 and 26 illustrate respective top and bottom perspective views of heel and forefoot core portions 2326 and 2328. FIG. 27 illustrates a top plan view of midsole rim 2222. As shown in FIG. 24, a bottom surface of midsole rim 2222 also includes a raised portion 2415 at a toe region of the midsole, similar to raised portion 615 of the embodiment shown in FIG. 6. As shown in FIG. 23, a top surface of midsole rim 2222 includes an optional recess 2336 for a tuck board or shank 2750, which is shown in FIG. 27. Shank 2750 can provide rigidity to a midfoot area of the sole.

Midsole rim 2222 further includes a heel opening 2332 and a forefoot opening 2334. Heel core portion 2326 may extend within heel opening 2332 so that a portion of the volume of the heel core portion 2326 is disposed in and closes heel opening 2332 and a top side 2322 of heel core portion 2326 is substantially flush with the top surface of midsole rim 2222. The remaining volume of the heel core portion 2326 extends below a bottom surface of midsole rim 2222. Similarly, forefoot core portion 2328 extends within forefoot opening 2334 so that a portion of the volume of the forefoot core portion 2328 is disposed in and closes forefoot opening 2334 and a top side 2322 of forefoot core portion 2328 is substantially flush with the top surface of midsole rim 2222. The remaining volume of the forefoot core portion 2328 extends below the bottom surface of midsole rim 2222. The volume of heel and forefoot core portions 2326 and 2328 that extends outside of midsole rim 2222 corresponds with heel and forefoot bulges 2215 and 2220 that can create controlled instability in the shoe. The size of heel core portion 2326 and forefoot core portion 2328 can be varied so that more or less volume of heel core portion 2326 and forefoot core portion 2328 extends outside of respective heel and forefoot openings 2332 and 2334 of midsole rim 2222, to obtain a more or less stable shoe as may be desired.

In some embodiments, heel or forefoot core portions 2326, 2328 may comprise a material having one or more different physical properties (e.g., density) than those of midsole rim 2222. In one embodiment, midsole rim 2222, and heel and forefoot core portions 2326, 2328 can be made of a foam material, such as polyurethane foam or EVA foam, a visco-elastic material, silicone, cast urethane, and combinations thereof. Suitable foam materials can include closed cell foams, open celled foams, reticulated foams and combinations thereof. In some embodiments, heel or forefoot core portions 2326, 2328 can be formed of discrete pieces of material, layers of materials, structured materials (e.g., honeycomb structured materials), or a combination thereof. In certain embodiments, heel or forefoot core portions 2326, 2328 includes a foam through which fluid, such as air, can flow. Components of the heel and forefoot core portions 2326, 2328 can be formed by various techniques known in the art such as, for example, die cutting, compression molding, injection molding, and blow molding.

In some embodiments, heel and forefoot core portions 2326, 2328 include a foam material that is softer than the foam material of midsole rim 2222. For example, in one embodiment, heel and forefoot core portions 2326, 2328 are made of a foam having a hardness of about 48 Asker C, and midsole rim 2222 is made of a polyurethane or EVA foam having a hardness of about 51-53 Asker C.

In addition to top side 2322, heel and forefoot core portions 2326, 2328 each have a bottom side 2324 and sidewalls 2325. Sidewall 2325 may extend substantially perpendicularly relative to bottom side 2324. In other embodiments (not shown), sidewall 2325 extends at an obtuse angle relative to bottom side 2324. A step 2327 extends between bottom side 2324 and sidewall 2325 of each of heel and forefoot core portions 2326, 2328. Step 2327 is received by a recess 2422 provided in the bottom surface of midsole rim 2222, at a periphery of openings 2332, 2334 adjacent the midfoot area. The fitting of step 2327 in recess 2422 allows heel and forefoot core portions 2326, 2328 to be properly positioned in respective openings 2332, 2334 of midsole rim 2222, and ensures that the core portions do not rotate in the openings.

Bottom sides 2324 of heel and forefoot core portions 2326, 2328 include an "+" shaped groove 2445, which aligns with tread groove 2245 of respective heel and forefoot outsoles 2236, 2237. In the embodiment illustrated in FIGS.

Figure 29:
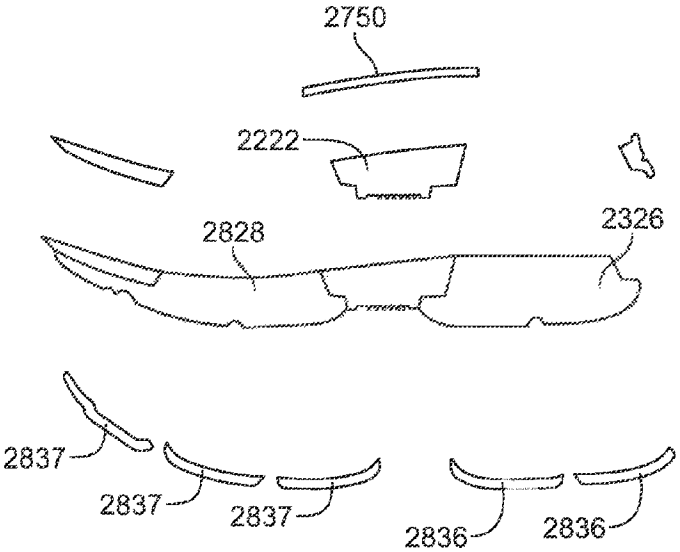
FIG. 29 is an exploded cross-sectional view of the sole of FIG. 28.

28 and 29, a sole includes midsole rim 2222, heel core portion 2326, forefoot core portion 2828 having an integral toe region 2815, heel outsole 2836, forefoot outsole 2837, and toe outsole portion 2825. In this embodiment, as shown in the cross-sectional view of FIG. 29, raised portion 2415 of midsole rim 2222 is replaced by toe region 2815 of forefoot core portion 2828.

Another embodiment of a footwear sole that may be incorporated into shoe 100 will now be described with reference to FIGS. 30-34. In this embodiment, a sole 3000 has a heel portion 3082 and a forefoot portion 3084. The sole includes an outsole 3036, a midsole 3021 having a midsole rim 3022, a heel core portion 3026, and a forefoot core portion 3028, a shank plate 3050, and an intermediate sole that comprises a resilient insert 3300 which is disposed between the midsole and the outsole.

A periphery of midsole rim 3022 is sculpted so as to have an upper ledge 3044 and a lower ledge 3046 with an indentation 3048 between ledges 3044 and 3046. The sculpted periphery of midsole rim 3022 can allow the midsole rim to flex under pressure. Under pressure, midsole rim 3022 may flex at indentation 3048 so that ledges 3044 and 3046 approach each other. This flexing can increase the instability of the shoe having midsole rim 3022, but still provide the wearer with proper support and control of the instability. Ledges 3044 and 3046 in midsole rim 3022 may be provided at either the heel portion 3082 or the forefoot portion 3084 of the sole, or at both the rearfoot and forefoot portions 3082, 3084. Moreover, ledges 3044, 3046 in midsole rim 3022 are preferably provided at the lateral and medial sides of the sole, so that the instability on each lateral and medial side of the shoe is comparable. In an alternative embodiment, the ledges 3044 and 3046 may be provided on only one side (e.g., the lateral side) of the sole. The wearer can engage their muscles to maintain a balanced gait in the shoe.

Figure 30:
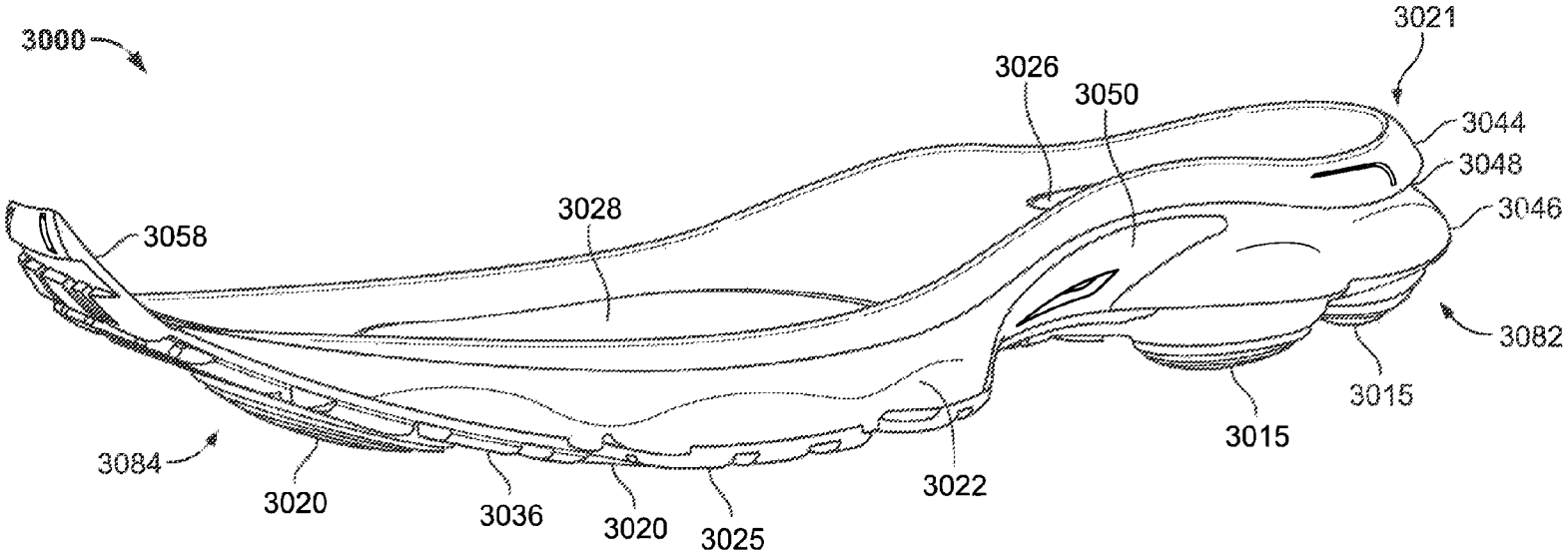
FIG. 30 is a top perspective view of a sole according to an embodiment of the present invention.

Midsole rim 3022 further includes a heel opening 3392 and a forefoot opening 3394 which accommodate respective heel and forefoot core portions 3026, 3028. A top surface of 3468 of heel core portion 3026 and a top surface 3462 of forefoot core portion 3028 are substantially flush with a top surface of midsole rim 3022, as shown in FIG. 30.

In some embodiments, heel or forefoot core portions 3026, 3028 may comprise a material having one or more different physical properties (e.g., density) than those of midsole rim 3022. In one embodiment, midsole rim 3022, and heel and forefoot core portions 3026, 3028 can be made of a foam material, such as polyurethane foam or EVA foam, a visco-elastic material, silicone, cast urethane, and combinations thereof. Suitable foam materials can include closed cell foams, open celled foams, reticulated foams and combinations thereof. In some embodiments, heel or forefoot core portions 3026, 3028 can be formed of discrete pieces of material, layers of materials, structured materials (e.g., honeycomb structured materials), or a combination thereof. In certain embodiments, heel or forefoot core portions 3026, 3028 includes a foam through which fluid, such as air, can flow. Components of the heel and forefoot core portions 3026, 3028 can be formed by various techniques known in the art such as, for example, die cutting, compression molding, injection molding, and blow molding.

In some embodiments, heel and forefoot core portions 3026, 3028 include a foam material that is softer than the foam material of midsole rim 3022. For example, in one embodiment, heel and forefoot core portions 3026, 3028 can be made of a foam having a hardness of about 30-36 Asker C, in another embodiment a hardness of about 32-34 Asker C, and in another embodiment a hardness of about 33 Asker C. Midsole rim 3022 can also be made of a foam material. In one embodiment, midsole rim 3022 can be made of a polyurethane or ethylene vinyl acetate (EVA) foam having a hardness of about 51-53 Asker C, and in another embodiment a hardness of about 51 Asker C.

In one embodiment, resilient insert 3300 may include a plurality of heel chambers and one or more forefoot chambers. In another embodiment, resilient insert 3300 may include one or more heel chambers and a plurality of forefoot chambers. In the embodiment illustrated in FIG. 33, resilient insert includes heel chambers 3314, 3315, 3316, 3317 surrounding a center heel chamber 3318. A connecting passage 3319 fluidly connects heel chambers 3314, 3315, 3316, 3317 in series, and another connecting passage (not shown) fluidly connects center heel chamber 3318 to one of the other heel chambers, preferably chamber 3315. The heel chambers are fluidly connected to a forefoot chamber 3312 by a passageway 3301, which may comprise an impedance structure (not shown), similar to passageway 260 and impedance structure 270 of resilient insert 200 described above with reference to FIG. 2. For example, the heel chambers can be fluidly connected via heel chamber 3314 to forefoot chamber 3312 by passageway 3301. Resilient insert 3300 is preferably preloaded so as to be at a pressure above ambient pressure at all times. Alternatively, the resilient insert may be at ambient pressure and only become preloaded when under weight of the wearer during use.

Similar to resilient insert 200, resilient insert 3300 may provide continuous cushioning to the wearer's foot, such that a wearer's stride forces a material (e.g., a fluid, a gel, a paste, or flowable particles) within the resilient insert to flow in a manner complementary with respect to the wearer's stride and the application of forces to the anatomical structure of the foot. Further description of exemplary resilient insert constructions which may be used as resilient insert 3300 is provided in U.S. Pat. No. 7,475,498 to Litchfield et al., which is incorporated herein in its entirety by reference thereto. It should be understood that alternate resilient insert constructions can be used in practice of embodiments of the present invention. In one embodiment, for example, the resilient insert includes at least two discrete forefoot and heel pieces not in fluid communication with each other, with each piece having one or more fluid, gel, paste, or particle-containing chambers fluidly connected to each other.

Outsole 3036 has a top surface 3420 and a bottom surface 3025. As shown, for example in FIGS. 30-32, bottom surface 3025 of outsole 3036 includes a plurality of heel bulges 3015 and a plurality of forefoot bulges 3020. Forefoot bulges 3020 include bulges 3121, 3123, and 3127, and heel bulges 3015 include bulges 3116, 3117, 3118, and 3119 surrounding a center heel bulge 3114. One or more of the plurality of heel bulges 3015 and forefoot bulges 3020 has a periphery 3154 that surrounds a bulge tread 3156. A deep groove 3152 is provided between bulge tread 3156 and periphery 3154. In this embodiment, bulge tread 3156 may have a plurality of concentric circular treads 3158 that are separated from each other by grooves and radiate from the center of the bulge. For example, as shown in FIG. 32A, which illustrates a cross-sectional view of heel bulge 3119, groove 3152 is disposed between bulge tread 3156 and periphery 3154, and is deeper than each groove 3258 between adjacent circular treads 3158. In one embodiment, the relative depth of deep groove 3152 to each grooves 3258 is about 2:1 or about 1.5:1. In one embodiment, groove 3152 has the substantially the same depth as one or more of grooves 3258, and in one embodiment, groove 3152 and each of grooves 3258 have substantially the same depth. Deep groove 3152 can allow the bulge to more easily move under pressure during a gait cycle and may provide a controlled instability that challenges the wearer's body to balance against as well providing cushioning. Grooves 3258 between circular treads 3158 may further assist in allowing the bulge to move.

Figure 33:
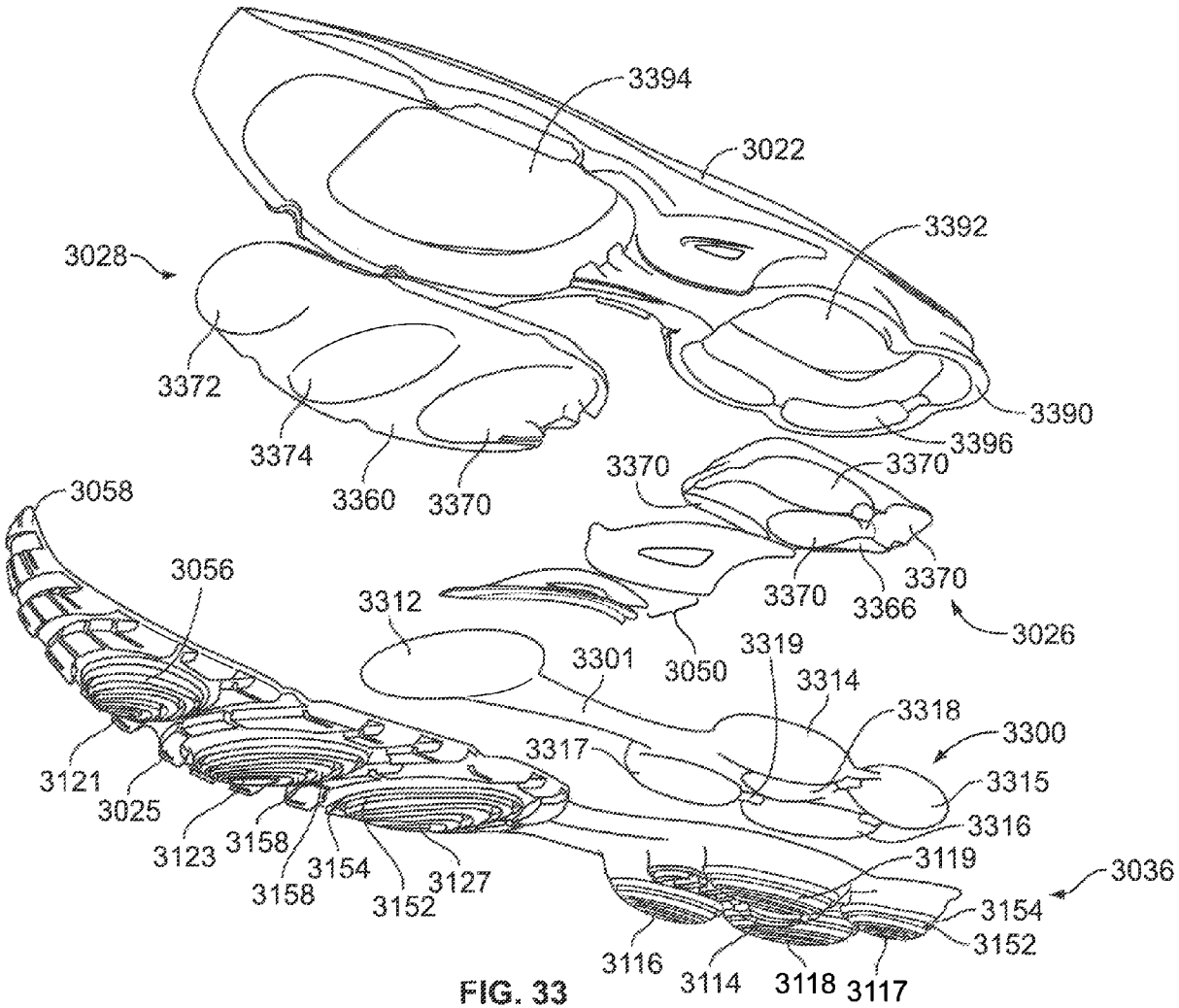
FIG. 33 is an exploded bottom perspective view of the sole of FIG. 30.
Figure 34:
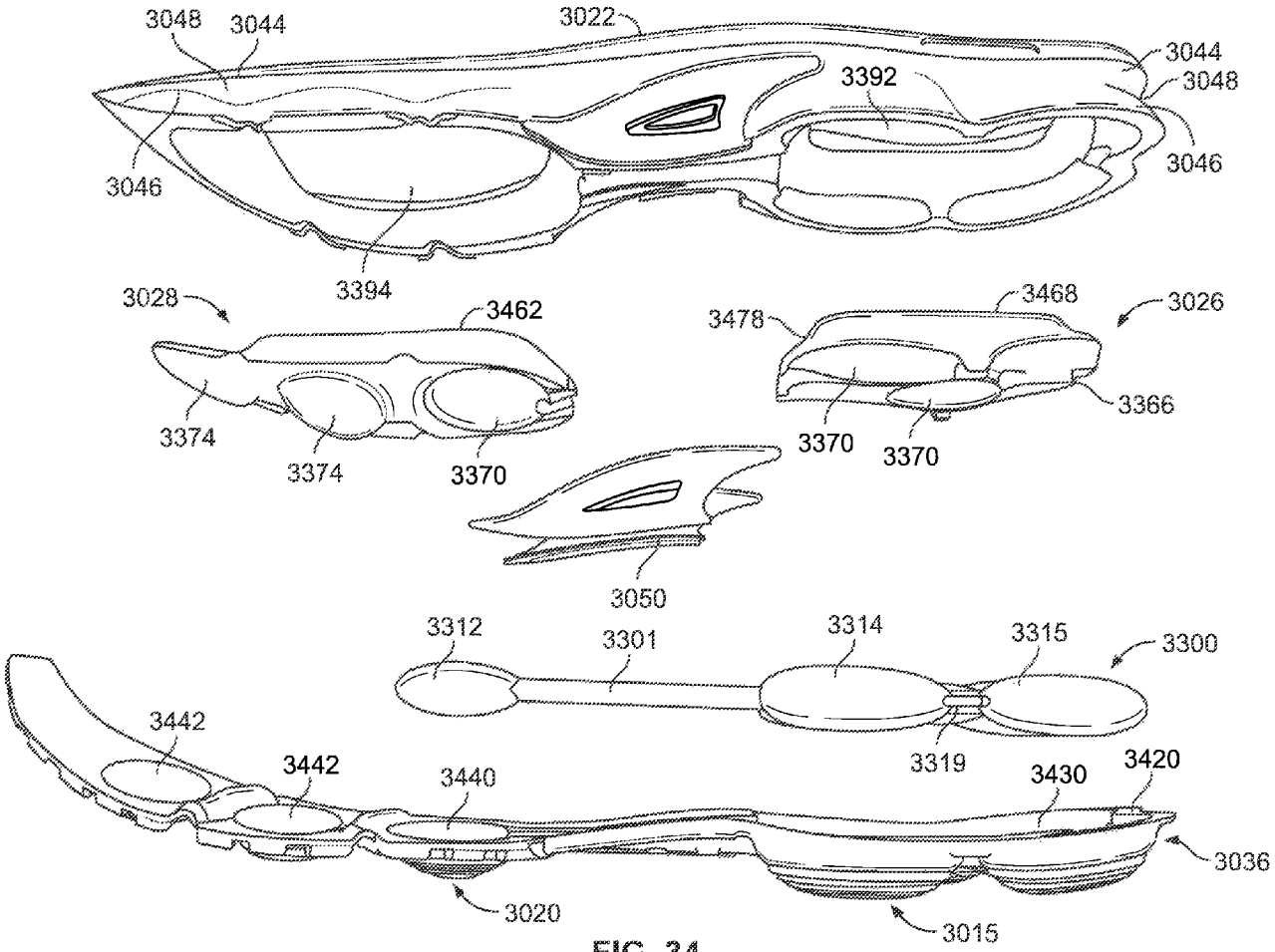
FIG. 34 is an exploded side perspective view of the sole of FIG. 30.

As shown in FIG. 34, heel bulges 3015 formed in bottom surface 3025 of outsole 3036 correspond with a plurality of heel cavities 3430 formed in top surface 3420 of outsole 3036. Top surface 3420 further includes a plurality of forefoot cavities that correspond with forefoot bulges 3020. The forefoot cavities include two cavities 3442 proximate a toe portion 3058 of outsole 3036, and a cavity 3440 adjacent the midfoot area of the sole. Forefoot cavity 3440 and heel cavities 3430 are sized to receive a portion of respective forefoot chamber 3312 and heel chambers 3314, 3315, 3316, 3317, and 3318. As shown in FIGS. 33 and 34, a bottom surface 3366 of heel core portion 3026 has indentations 3370 that join adjacent indentations 3396 in a bottom surface 3390 of midsole rim 3022. Each set of corresponding indentations 3370 and 3096 together form a cavity that accommodates a portion of the corresponding heel chambers of resilient insert 3300. Forefoot core portion indentation 3370 and heel region indentations 3370, 3396 correspond to forefoot and heel chambers 3312, 3314, 3315, 3316, 3317, and 3318 of resilient insert 3300. However, the cavities formed by indentations 3370 and 3096 are sized such that they do not accommodate the entire volume of the chambers of resilient insert 3300. Cavities formed by indentations 3370 and 3096 in conjunction with forefoot cavity 3440 and heel cavities 3430 of outsole 3036 substantially accommodate resilient insert 3300 when the sole is assembled. By adjusting the volume of resilient insert 3300 that is accommodated in cavities 3370 of heel and forefoot core portions 3026 and 3028, it is possible to change the amount and/or rate at which forefoot bulge 3127 and the plurality of heel bulges 3015 collapse as force is applied to the sole.

Heel and forefoot core portions 3026 and 3028 have side walls 3478 extending between their respective top and bottom surfaces. For ease of assembly of the heel and forefoot core portions with midsole rim 3022, sidewalls 3478 preferably may extend at an obtuse angle with respect to the bottom surfaces 3366 and 3360 of respective heel and forefoot core portions 3026 and 3028.

As shown in FIG. 33, forefoot core portion 3028 further includes bulges 3372 and 3374 that are disposed forward of cavity 3370 that receives forefoot chamber 3312. Bulges 3372 and 3374 are integral with forefoot core portion and are accommodated in cavities 3442 of outsole 3036. Alternatively, in other embodiments (not shown), bulges 3372 and 3374 can be omitted such that cavities 3442 of outsole 3036 are hollow, or can each be replaced with a fluid filled bladder, gel piece, or other fluid chamber accommodated in respective cavities 3442 of outsole 3036. In another embodiment (not shown), bulges 3372 and 3374 can be omitted and replaced with a resilient insert with two chambers fluidly connected to each other. Alternatively, one or both bulges 3372, 3374 may be replaced with a resilient insert portion connected to chamber 3312 of insert 3300.

Figure 31:
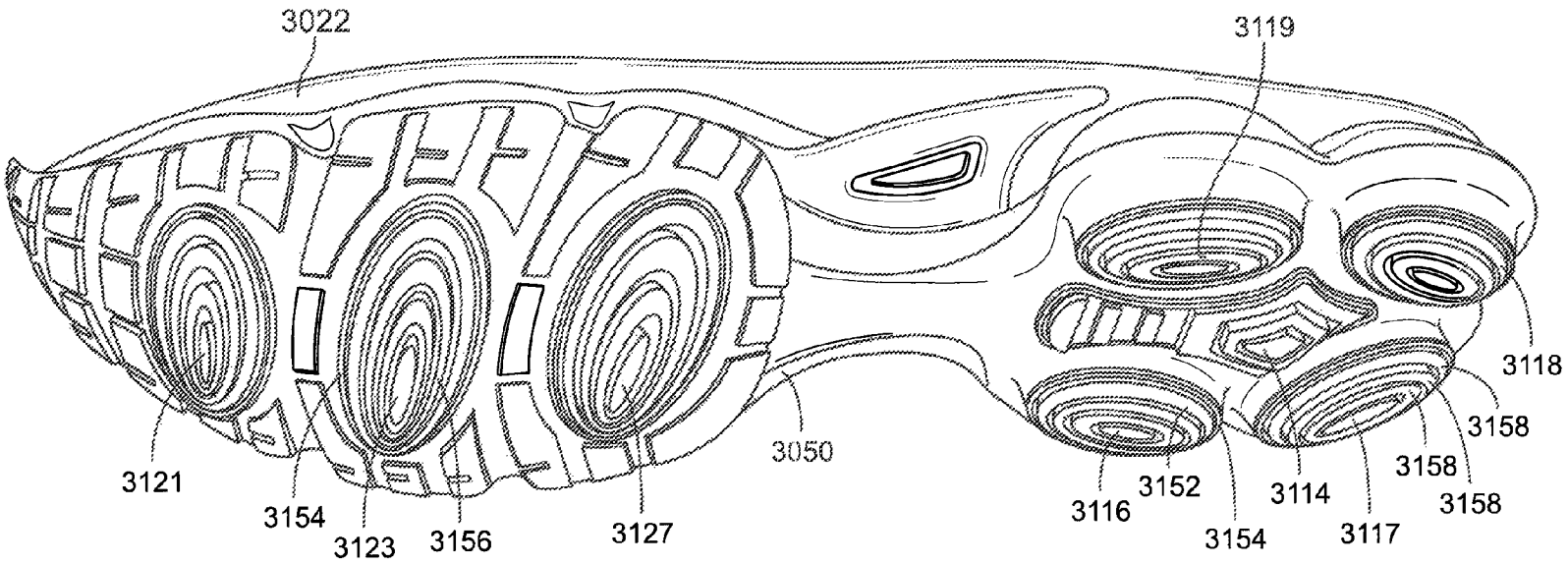
FIG. 31 is a bottom perspective view of the sole of FIG. 30.
Figure 32:
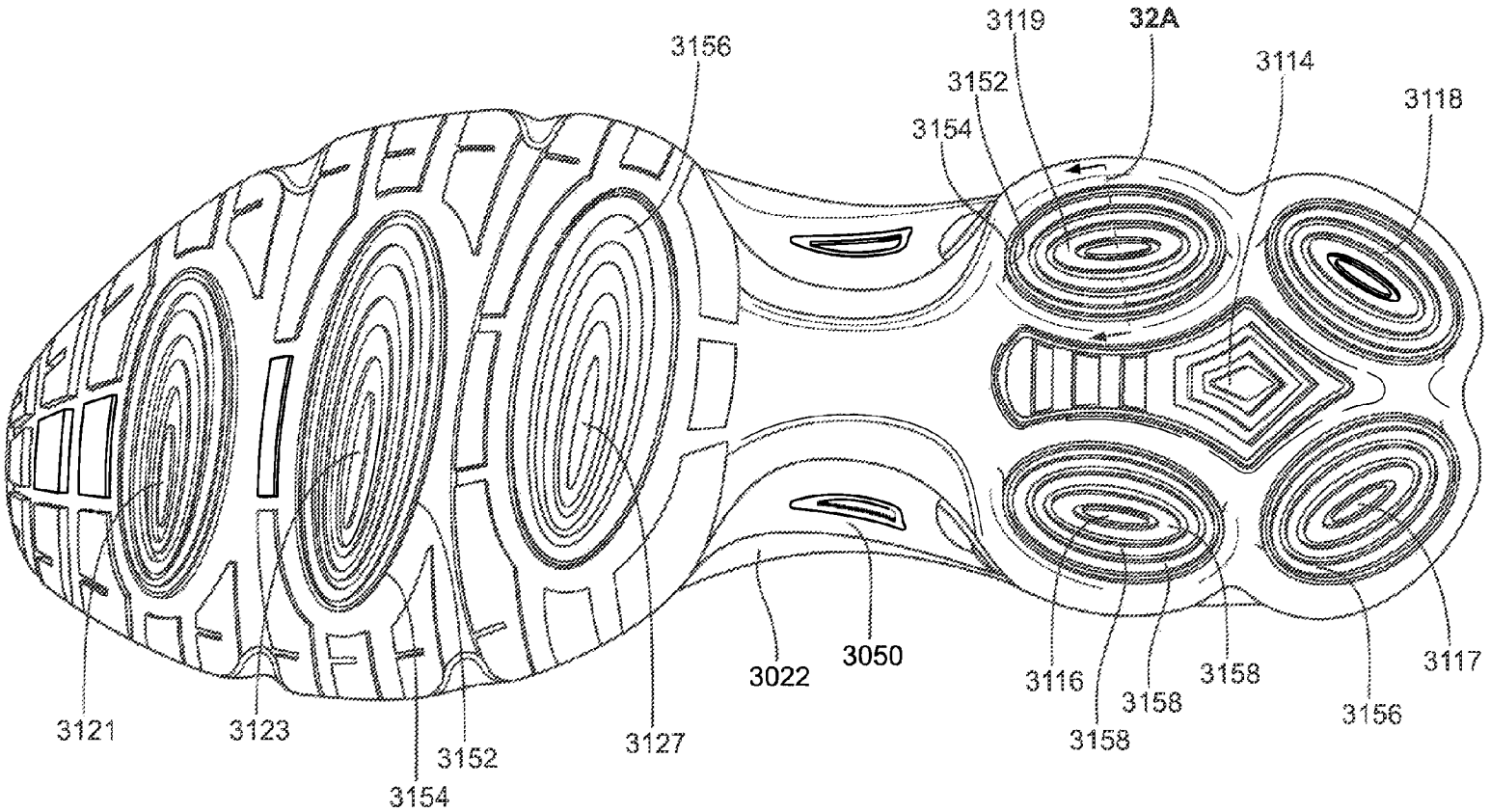
FIG. 32 is a bottom plan view.
Figure 32A:
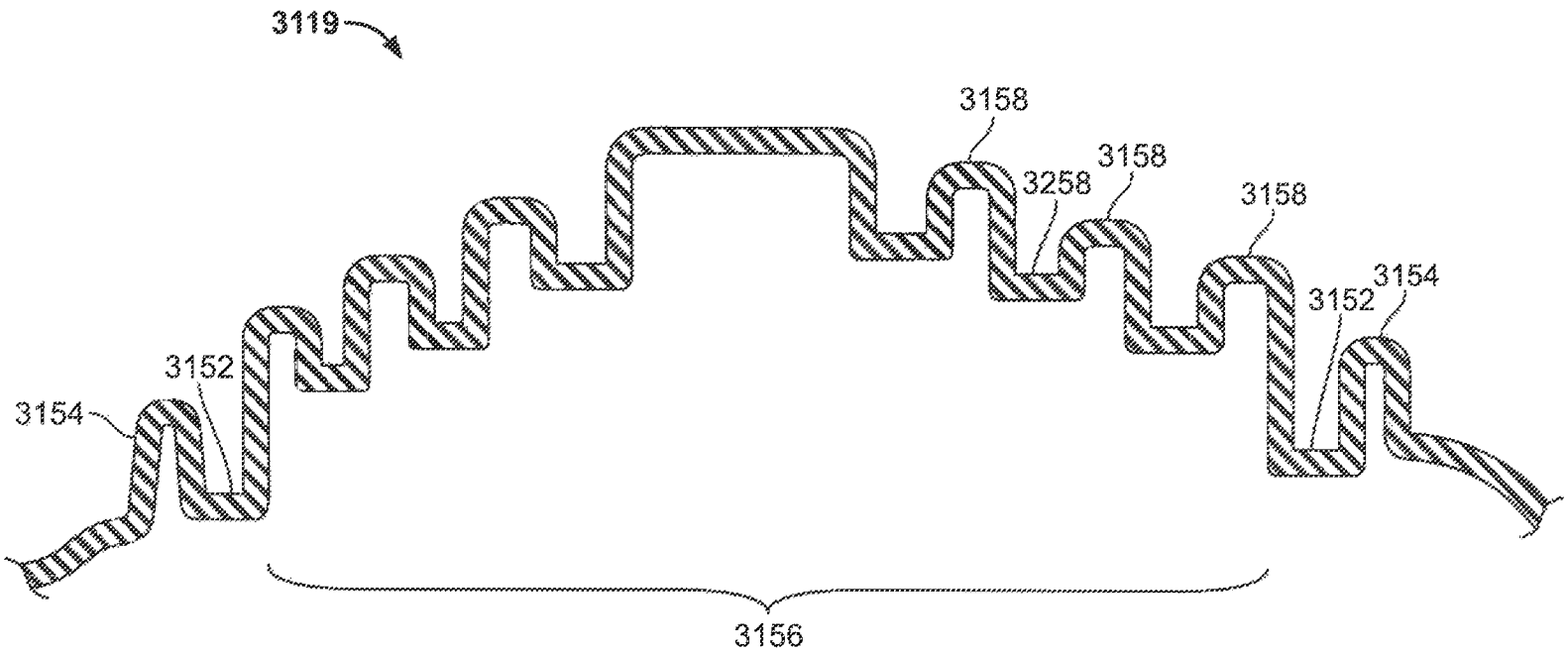
FIG. 32A is a cross-sectional view of the outsole of the sole of FIG. 30, taken along the line 32A-32A in FIG. 30, according to an embodiment of the present invention.
Figure 35:
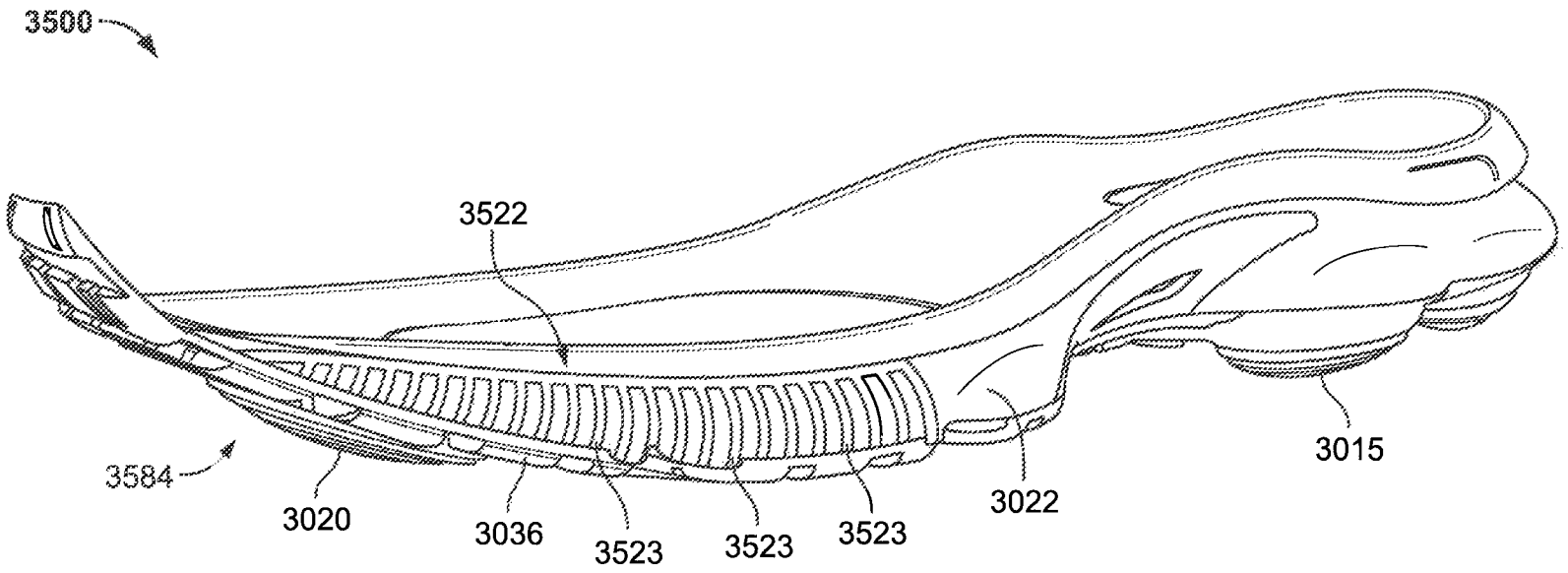
FIG. 35 is a top perspective view of a sole according to an embodiment of the present invention.

In another embodiment, shown in FIG. 35, a forefoot portion 3584 of a sole 3500 includes a siped midsole portion 3522 forward of forefoot bulge 3127 (shown, e.g., in FIG. 31). Siped midsole portion 3522 includes a plurality of sipes 3523 that can flex to absorb shock during the gait cycle of a wearer. In a preferred embodiment, the sipes 3523 are slits in the midsole material which extend substantially the entire width of the midsole. The midsole material in which the sipes 3523 are located may be a different material than the material forming the rest of the midsole. In an alternative embodiment, the sipes 3523 may extend across a portion of the width of the midsole.

The outsole heel bulges 3015 and forefoot bulge 3312 can maintain at least some curvature during the gait cycle because these bulges house a portion of a chamber of resilient insert 3300. Bulges 3121 and 3123 can also maintain curvature particularly when they house the bulges of the heel and forefoot core portions, or other component, such as a gel piece as discussed above. Also as discussed above, when curvature is maintained in the outsole bulges, a wearer's muscles may be forced to exert themselves more strenuously, or different muscles can be activated, to stabilize the gait.

Another embodiment of a footwear sole that may be incorporated into shoe 100 will now be described with reference to FIGS. 36-39. In this embodiment, a sole 3600 includes an outsole 3636, a shank plate 3650, and a midsole 3622 and an intermediate sole 3621 that includes a two-piece resilient insert consisting of a heel resilient insert 3602 and a forefoot resilient insert 3604.

Outsole 3636 has a top surface 3720 and a bottom surface 3625, and can be separated into a rearfoot piece 3732 and a forefoot piece 3734, which has a toe portion 3658. Bottom surface 3625 of outsole 3636 includes a plurality of heel bulges 3615 and a plurality of forefoot bulges 3620. Forefoot bulges 3620 correspond with a plurality of forefoot cavities 3721, 3722, 3723, 3724, 3727, and 3728 formed in top surface 3720 of forefoot piece 3734 of outsole 3636. Heel bulges 3615 correspond with heel cavities 3716, 3717, 3718, and 3719 formed in top surface 3720 of rearfoot piece 3732 of outsole 3636.

Each of the plurality of heel bulges 3615 and plurality of forefoot bulges 3620 can include a bulge tread 3656 and a periphery 3654 that surrounds the bulge tread. A deep groove (not shown in this embodiment) can be provided between periphery 3654 and bulge tread 3656 similar to deep groove 3152 described above with reference to FIG. 32A.

Each of forefoot resilient insert 3604 and heel resilient insert 3602 includes a plurality of heel chambers. In the embodiment illustrated in FIGS. 38 and 39, heel resilient insert 3602 includes four heel chambers 3780, 3782, 3784, and 3786, and forefoot resilient insert 3604 includes six forefoot chambers 3710, 3711, 3712, 3713, 3714, and 3715 A connecting passage 3818 fluidly connects the forefoot chambers together in series, and a connecting passage 3988 fluidly connects the heel chambers together in series. Either or both connecting passages 3818 and 3988 may include an impedance structure (not shown) which acts as a regulator to control the flow of a material as it flows from one chamber to the other. The impedance structure may take any form known in the art, such as, for example, structures disclosed in U.S. Pat. No. 6,845,573 to Litchfield et al., and that disclosed in U.S. Pat. No. 6,505,420 to Litchfield et al., the disclosures of which are hereby incorporated in their entirety by reference thereto. Heel resilient insert 3602 and forefoot resilient insert 3604 are not fluidly connected together. Alternatively, in another embodiment (not shown), a passageway may fluidly connect heel resilient insert with forefoot resilient insert.

Resilient insert 3602 is preferably preloaded with a gas such as nitrogen at about 4 psi. Alternatively, an inflation system, such as an air pump and release mechanism, can be used to alter the pressure of a fluid within the resilient insert.

In such an instance, it is preferred that the inflation system inflate the chambers up to about 10 psi. Examples of an inflation system suitable for use with the resilient insert include inflation systems having pumps actuated by the pressure exerted by a wearer's foot, pumps actuated by a wearer's hand, electronically actuated pumps, and automatically actuated pumps. In addition, inflation systems can contain one or more of the following: valves, one-way valves, release valves, pressure regulators, manifolds, conduit, pressure transducers, automated or electronic control systems, power sources, air inlets, and pressurized gas sources.

The heel and forefoot resilient inserts are preferably made of thermoplastic elastomer. In one embodiment, the resilient inserts can be made of about 85-98 Shore A TPU, and in other embodiments the resilient inserts are made of TPU of about 88 to about 96 Shore A, about 90 to about 95 Shore A, or about 95 Shore A. A preferred method for manufacturing the resilient insert is extrusion blow molding. If the resilient inserts are preloaded with gas, it is preferred that each resilient insert is blow molded, partly cooled, and then filled with nitrogen at a filling conduit of the resilient insert (see, e.g., filling conduit 3898 shown in FIG. 38). The TPU is preferably still pliable after filling to allow conduit 3898 to be pinched closed to seal the resilient insert.

It is preferred that the resilient inserts are relatively soft and easily compressed so that the sole is unstable in a controlled manner and requires the wearer to use muscles to correct for stability or energy loss. To achieve this, the resilient inserts are made of a plastic, such as described above, that is relatively soft but that is still hard enough to be resilient and provide the chambers with controlled compressibility, or the walls of the chambers are thin, having a thickness of, for example, about 1.0 mm to about 1.5 mm or about 1.1 to about 1.4 mm, or the resilient inserts are made of a relatively soft, thin-walled plastic. In some embodiments, the material composition of the chambers of the forefoot resilient insert may be different from that of the chambers of the heel resilient insert. In one embodiment, the wall thickness of the chambers of the forefoot resilient insert may be different from the wall thickness of the chambers of the heel resilient insert. A combination of relatively soft plastic and thin chamber walls may result in chambers that are more easily compressed. In addition, one or more of the chambers (preferably all of the chambers) of the resilient inserts have a pronounced convex bottom surface 3790 with an integral hinge 3792 that surrounds a periphery of the convexity of the bottom surface, which may allow easier flexing of the chambers under pressure during a gait cycle. Easier flexing of the chambers provides controlled instability or energy loss, and the wearer must compensate for the reduced stability or energy loss by using their muscles. FIGS. 44A, 44B, 45A, and 45 provide exemplary cross-sectional views of a forefoot and heel chamber showing hinge 3792. As shown, hinge 3792 is comprised of a ledge 4494 that is integrally formed with the chamber during molding of the resilient insert. During a gait cycle, convex bottom surface 3790 of the chamber is compressed by force of the wearer's foot on the ground. The convex surface flexes upward, and there is less resistance to this movement by virtue of ledge 4494. Only heel chamber 3782 and forefoot chamber 3715 are illustrated in these cross-sectional views, but it should be understood that a similar hinge construction can be provided for each of the convex bottom surfaces of the other chambers of the heel and forefoot resilient inserts.

Each of the forefoot and heel chambers has a concave top surface 3794 for conforming to a wearer's foot. Heel and forefoot resilient inserts 3602 and 3604 may provide continuous cushioning to the wearer's foot, such that a wearer's stride forces a material (e.g., a fluid, a gel, a paste, or flowable particles) within the resilient inserts to flow in a manner complementary with respect to the wearer's stride and the application of forces to the anatomical structure of the foot. In one embodiment, with the exception of hinge 3792 and wall thickness of the chambers of the resilient inserts, heel and forefoot resilient inserts 3602 and 3604 may comprise a structure similar to that disclosed in U.S. Pat. No. 6,354,020 to Kimball, et the disclosure of which is incorporated herein in its entirety by reference thereto. It should be understood that alternate resilient insert constructions can also be used in practice of the present invention.

Midsole 3622 has a bottom surface 3780 having cavities 3786 that cradle a portion of corresponding chambers of heel and forefoot resilient inserts 3602 and 3604. However, cavities 3786 are formed such that they do not accommodate the entire volume of the chambers of heel and forefoot resilient inserts 3602 and 3604. By adjusting the volume of heel and forefoot resilient inserts 3602 and 3604 that is accommodated in cavities 3786, it is possible to change the amount and/or rate at which the forefoot bulge 3620 and heel bulges 3615 collapse as force is applied to the sole. Moreover, the plurality of forefoot and heel cavities in outsole 3636 in conjunction with cavities 3786 of midsole 3622 do not completely house heel and forefoot resilient inserts 3602 and 3604. Rather, heel and forefoot resilient inserts 3602 and 3604 are exposed at the sides of the sole, as illustrated in FIG. 36.

Figure 36:
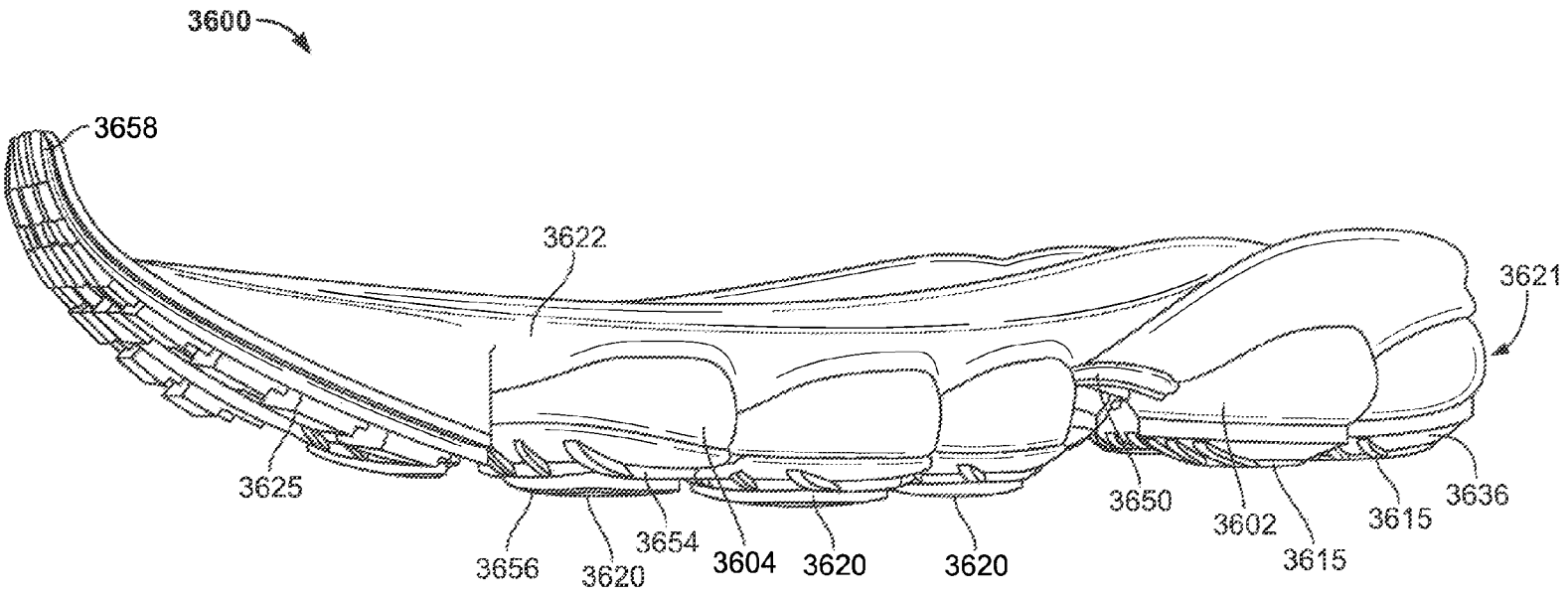
FIG. 36 is a side perspective view of a sole according to an embodiment of the present invention.
Figure 37:
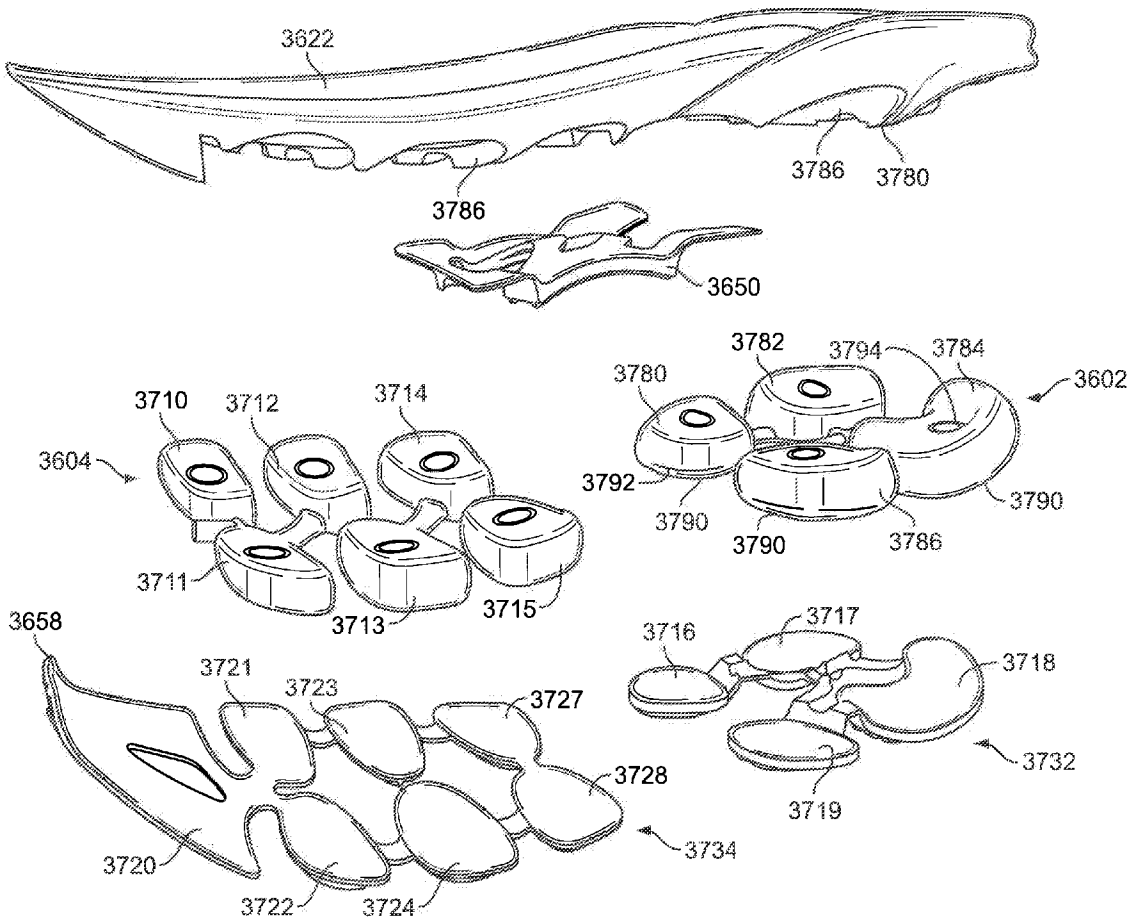
FIG. 37 is an exploded top perspective view of the sole of FIG. 36.
Figure 38:
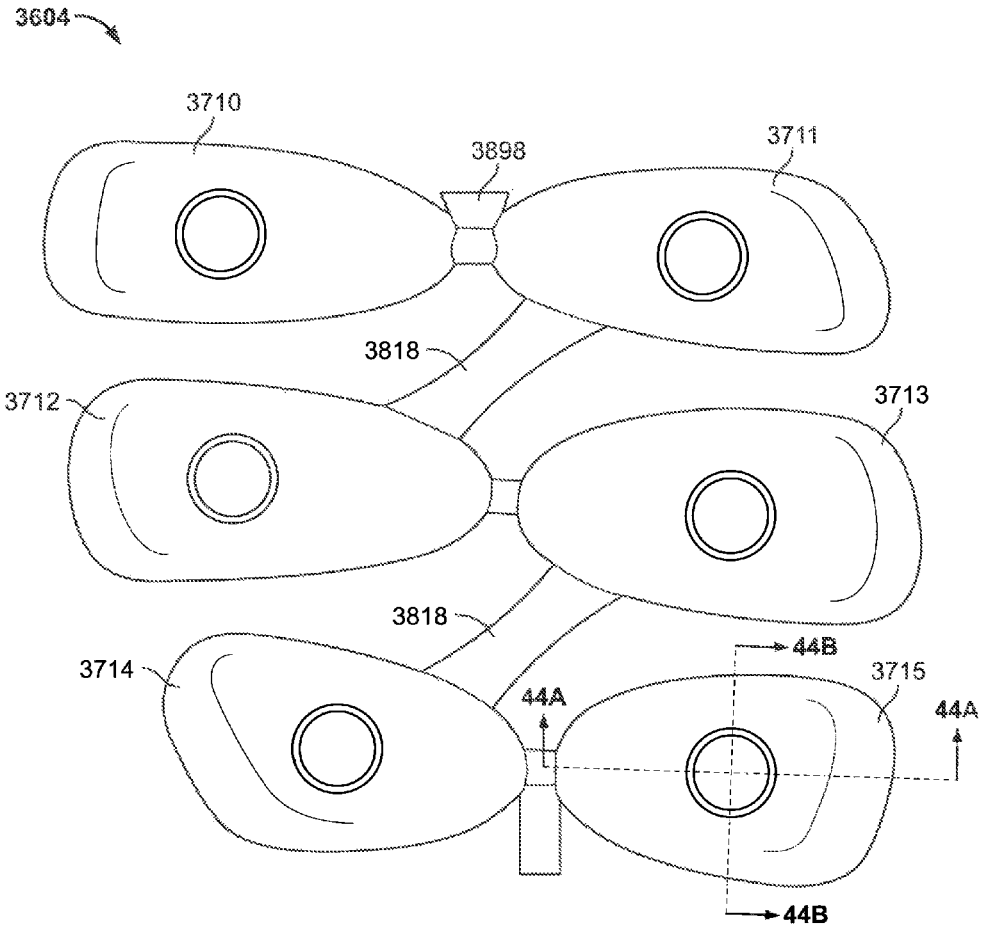
FIG. 38 is a top plan view of a forefoot resilient insert according to an embodiment of the present invention.
Figure 39:
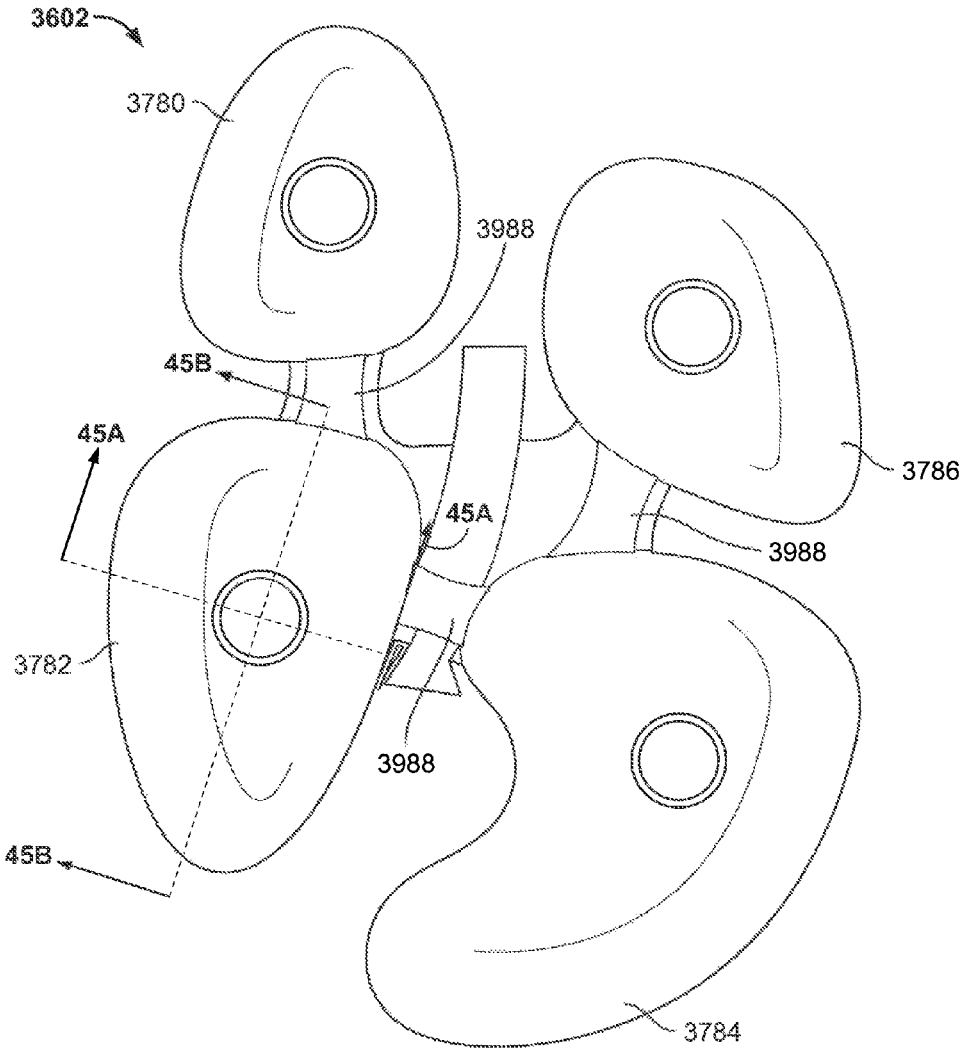
FIG. 39 is a top plan view of a heel resilient insert according to an embodiment of the present invention.
Figure 40:
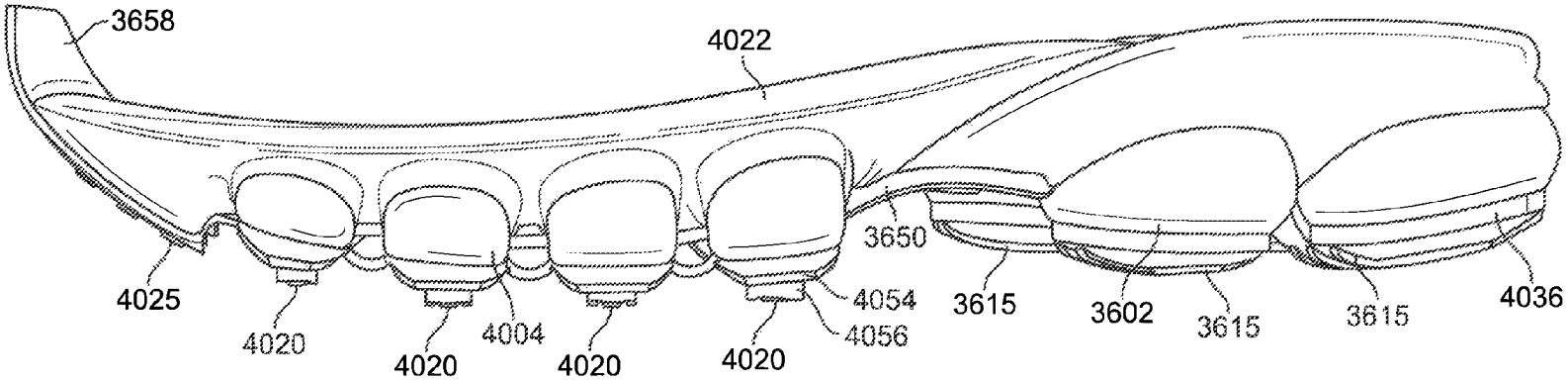
FIG. 40 is a side perspective view of a sole according to an embodiment of the present invention.
Figure 41:
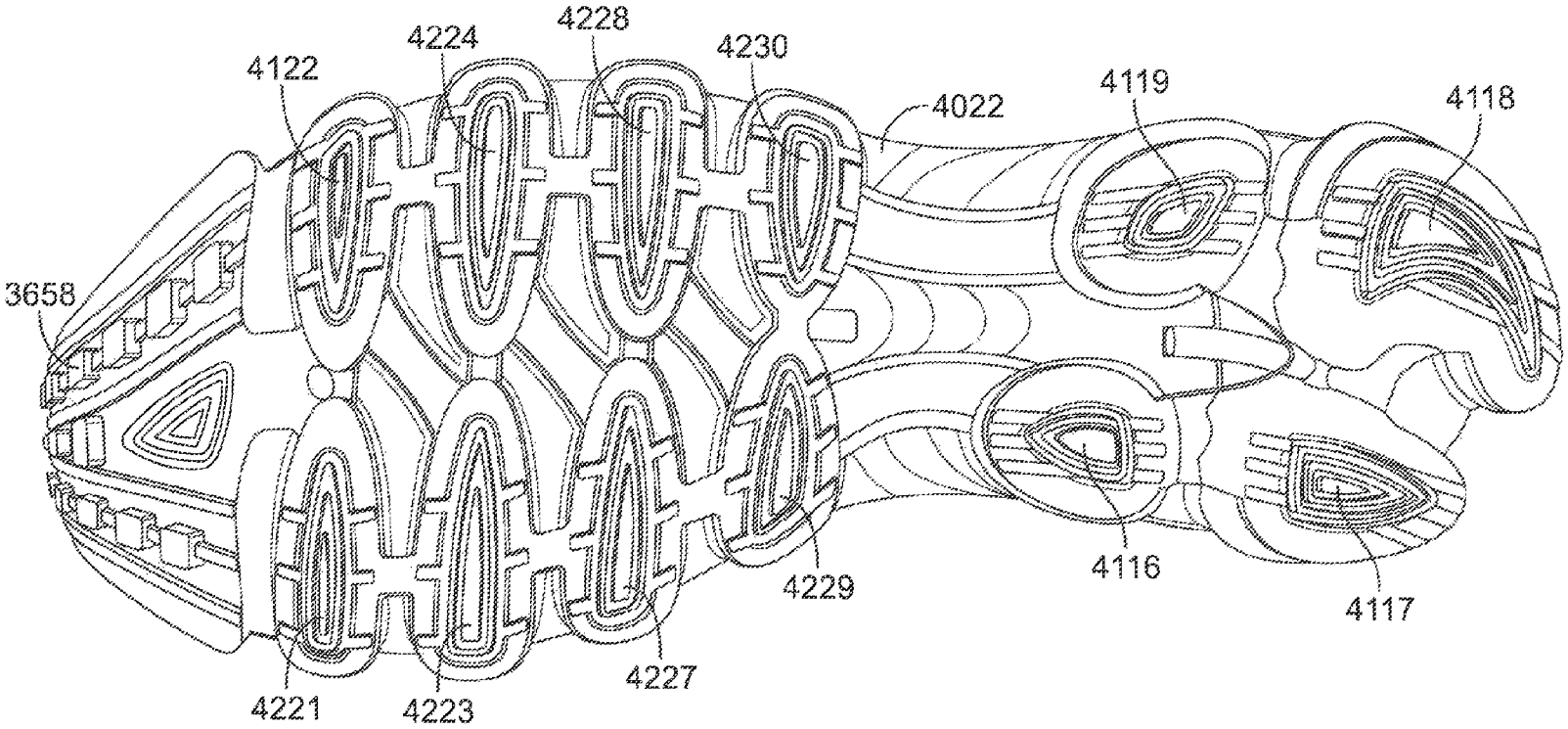
FIG. 41 is a bottom plan view of the sole of FIG. 40.
Figure 42:
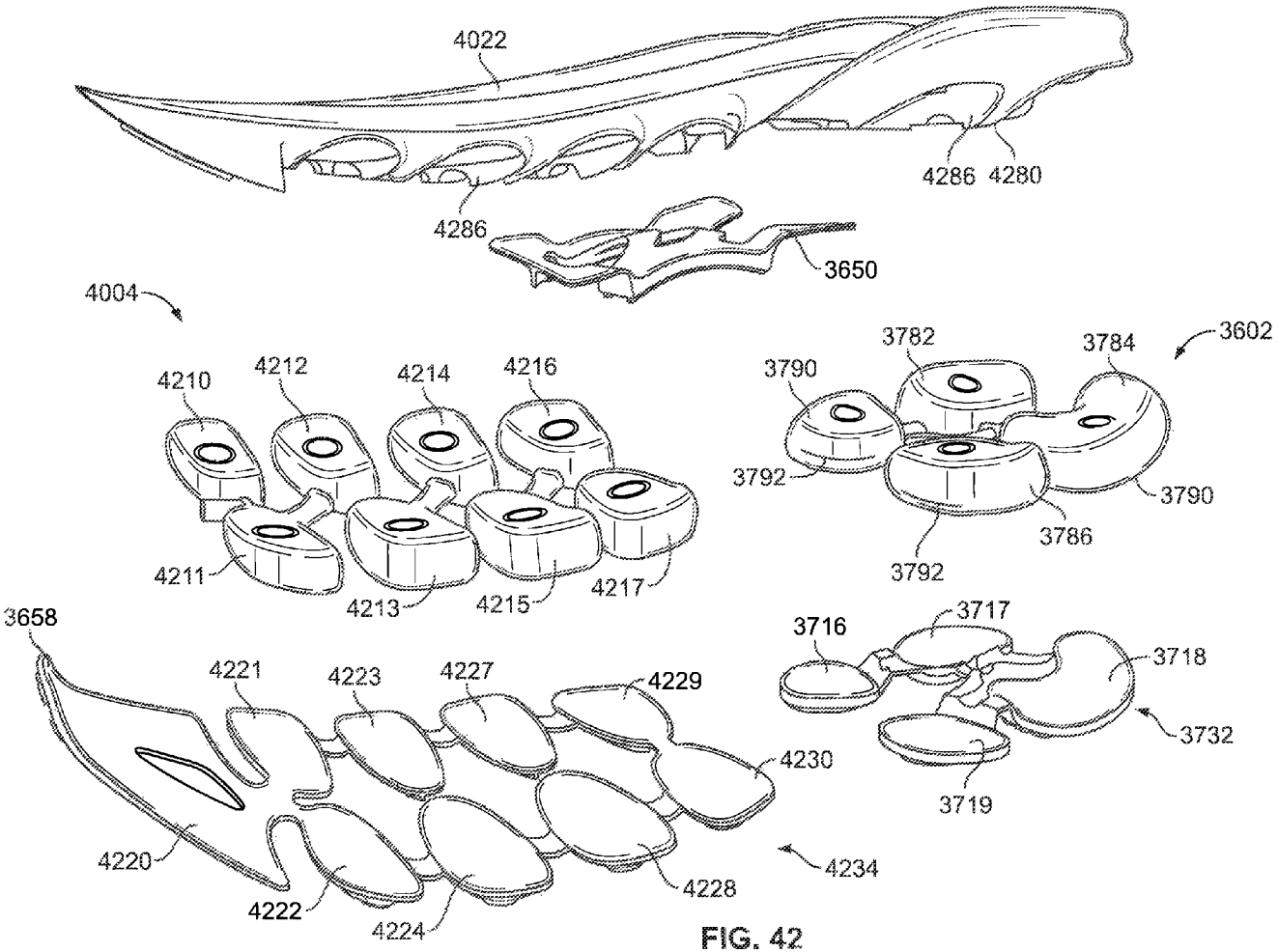
FIG. 42 is an exploded top perspective view of the sole of FIG. 40.
Figure 43:
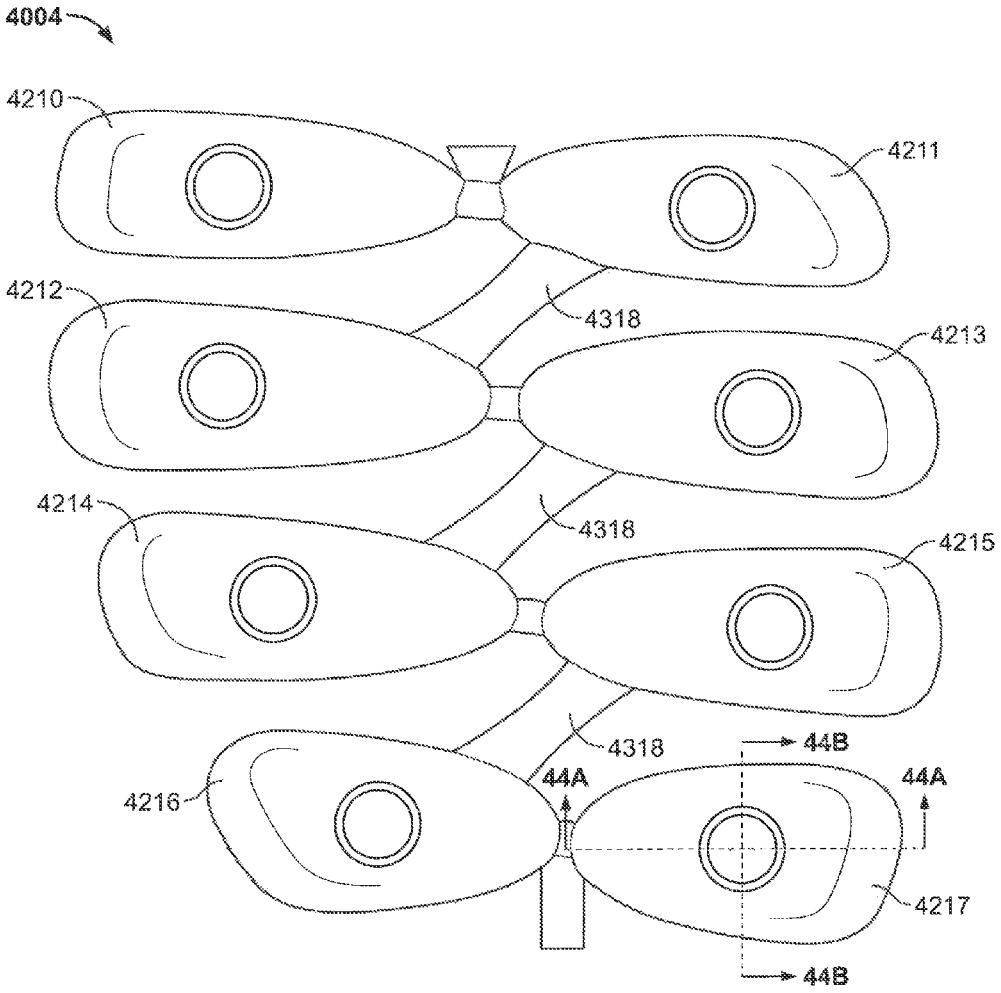
FIG. 43 is a top plan view of a forefoot resilient insert according to an embodiment of the present invention.

In an alternative embodiment illustrated in FIGS. 40-43, the forefoot portion of sole 3600 of FIG. 36 has been modified to include a forefoot resilient insert 4004 having eight chambers 4210, 4211, 4212, 4213, 4214, 4215, 4216, and 4217. These chambers are fluidly connected together by connecting passages 4318. Correspondingly, an outsole 4036 includes a forefoot piece 4234 having a top surface with a plurality of cavities 4121, 4122, 4123, 4124, 4127, 4128, 4129, and 4130, and a bottom surface 4025 with a plurality of bulges 4020 having a bulge tread 4056 surrounded by a periphery 4054. Likewise, a midsole 4022 has a plurality of cavities 4286 that cradle a portion of corresponding chambers of forefoot resilient insert 4004 and previously-described heel resilient insert 3602.

Figure 44A:
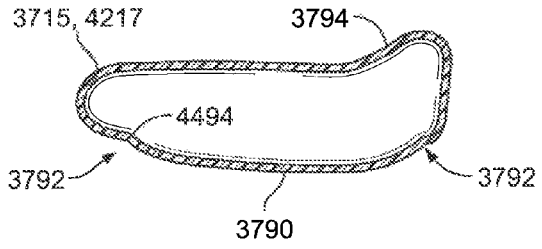
FIG. 44A is a cross-sectional view of a forefoot chamber taken along the line 44A-44A in both FIGS. 38 and 43, according to an embodiment of the present invention.
Figure 44B:
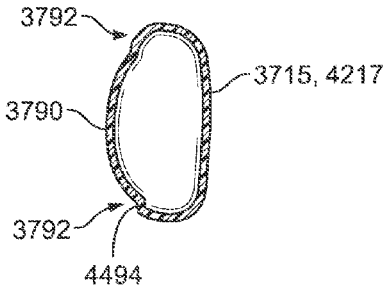
FIG. 44B is a cross-sectional view of a forefoot chamber taken along the line 44B-44B in both FIGS. 38 and 43, according to an embodiment of the present invention.
Figure 45A:
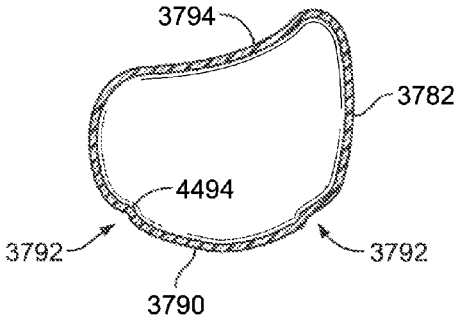
FIG. 45A is a cross-sectional view of a forefoot chamber taken along the line 45A-45A in FIG. 39, according to an embodiment of the present invention.
Figure 45B:
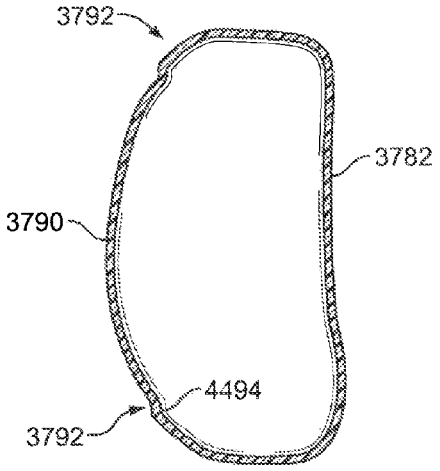
FIG. 45B is a cross-sectional view of a forefoot chamber taken along the line 45A-45A in FIG. 39, according to an embodiment of the present invention.

Like the embodiment of FIG. 36, one or more of the chambers of forefoot resilient insert 4004 have convex bottom surfaces 3790 and hinge 3792 comprised of ledge 4494 that is integrally formed with the chamber during molding of the resilient insert. FIGS. 44A and 44B, showing forefoot chamber 4217, can be considered to be an exemplary illustration of hinge 3792 of a forefoot chamber of resilient insert 4004.

As noted elsewhere, these exemplary embodiments have been described for illustrative purposes only, and are not limiting. For example, in any of the aforementioned embodiments, it is contemplated that the size of the bulges of the sole's bottom surface may be modified to provide the desired stability and corresponding exertion level for the wearer. For example, for the embodiments of FIGS. 30, 35, 36 and 40, each bulges may have a convex shape and have a perimeter, each bulge may reach its maximum vertical displacement from its perimeter at a point that lies generally in the center of the bulge, and the maximum vertical displacement beyond the level of its perimeter may be modified to provide the desired stability and corresponding exertion level for the wearer. For example, the maximum vertical displacement beyond the level of the perimeter may be at least about 2 millimeters, at least about 3 millimeters, at least about 4 millimeters, at least about 5 millimeters, or at least about 6 millimeters.

Similarly, for example, for the embodiment of FIG. 22, heel and forefoot bulges may have a convex shape, heel and forefoot core portions may have convex bottom surfaces corresponding with the convex shape of the bulges, and a midsole rim may be sized to accommodate about, for example, no more than about 50% by volume of the heel and forefoot core portions, about 40% to about 50% or about 45% to about 50% by volume, or can be sized to accommodate no more than about 60% by volume. The remaining portion of the volume of the heel and forefoot core portions extends below the bottom surface of the midsole rim. The heel and forefoot core portions may reach their maximum vertical displacement from the bottom surface of the midsole rim at a point that lies generally in the center of the convex surface of the heel and forefoot core portions, and this maximum vertical displacement may be modified to provide the desired stability and corresponding exertion level for the wearer. For example, the maximum vertical displacement may be at least about 2 millimeters, at least about 3 millimeters, at least about 4 millimeters, at least about 5 millimeters, or at least about 6 millimeters.

In addition, in any of the aforementioned embodiments, the bulges can be an integral component of the sole of the article of footwear and not removable therefrom, with bulges being integral with the bottom surface of the sole. In addition, the shape of the bulges may be any geometrical shape, such as circular, triangular, hexagonal, and/or other polygonal shape or combinations thereof, while still having a convex shape for providing a controlled rocking motion, or instability. Moreover, an article of footwear according to embodiments of the present invention may be supportive while still providing the wearer with an instability that the wearer's muscles can compensate for and be conditioned during the gait cycle. An article of footwear according to embodiments of the present invention can achieve the controlled instability of the shoe which can be achieved by bulges or by other mechanisms. For example, a forefoot and/or heel midsole of soft foam pillars or a soft foam midsole that is siped, such as siped midsole 3522, may be used to make the sole unstable in a manner that is controlled and allows the wearer's body to stabilize and maintain balance in the shoe during the gait cycle.

Moreover, embodiments according to the present invention include modifying the forefoot or heel portion of the sole structure of one embodiment to incorporate the forefoot or heel portion of the sole structure of another embodiment. For example, the forefoot or beef portion of the sole of embodiment of FIGS. 36 and 40 may be modified to include the forefoot or heel portion of the sole of the embodiment of FIG. 22. Other embodiments are possible and are covered by the methods and systems described herein. Such embodiments will be apparent to persons skilled in the relevant art(s) based on the teachings contained herein. Thus, the breadth and scope of the methods and systems described herein should not be limited by any of the above-described exemplary embodiments, but should be defined only in accordance with the following claims and their equivalents.

What is claimed is:

1. A sole for an article of footwear, the sole comprising:
an outsole having a bottom surface; and
a bulge formed in the bottom surface of the outsole,
wherein the bulge has a frusto-ellipsoidal shape,
wherein the frusto-ellipsoidal shape includes an elliptical outer groove surrounding an inner portion of the bulge and a plurality of elliptical inner grooves disposed at the inner portion of the bulge, and
wherein a depth of the outer groove is greater than a depth of the inner grooves.

2. The sole of claim 1, wherein the outer groove is defined by opposing vertical side walls spaced apart by a horizontal wall.

3. The sole of claim 1, wherein the outer groove is defined by opposing vertical side walls, and
wherein one sidewall of the opposing vertical sidewalls is higher than the other sidewall of the opposing vertical sidewalls.

4. The sole of claim 1, wherein the depth of the outer groove is at least 1.5 times greater than the depth of the inner grooves.

5. The sole of claim 1, wherein the bottom surface of the outsole defines a substantially flat platform surface surrounding the bulge.

6. The sole of claim 1, wherein the bottom surface of the outsole defines a substantially flat platform surface surrounding the bulge, and
wherein the platform surface extends from the outer edge of the elliptical outer groove.

7. The sole of claim 1, wherein the sole comprises a plurality of bulges in the bottom surface of the outsole,
wherein each of the plurality of bulges has a frusto-ellipsoidal shape,
wherein the frusto-ellipsoidal shape of each of the bulges includes an elliptical outer groove surrounding an inner portion of the bulge.

8. A sole for an article of footwear, the sole comprising:
an outsole having a bottom surface comprising an outer elliptical tread and a plurality of nested inner elliptical treads nested within the outer elliptical tread,
wherein each tread is separated from an adjacent tread by an elliptical groove,
wherein each inner tread protrudes lower than the adjacent tread surrounding it, and
wherein the groove separating the outer tread and the inner treads is deeper than the grooves separating adjacent inner treads.

9. The sole of claim 8, wherein the nested inner elliptical treads are concentric with each other and with the outer elliptical tread.

10. The sole of claim 8, wherein a center axis of each inner elliptical tread is offset from a center axis of the adjacent tread surrounding it.

11. The sole of claim 8, wherein a center axis of each inner elliptical tread is offset from a center axis of the adjacent tread surrounding it, and
wherein all inner elliptical treads are offset in the same direction.

12. The sole of claim 8, wherein the bottom surface of the outsole comprises a plurality of outer elliptical treads, and a plurality of inner elliptical treads arranged within each of the outer elliptical treads.

13. The sole of claim 12, wherein the plurality of outer elliptical treads and the plurality of inner elliptical treads are disposed in a forefoot of the outsole.

14. The sole of claim 12, wherein the plurality of outer elliptical treads and the plurality of inner elliptical treads are disposed in a heel of the outsole.

15. A sole for an article of footwear, the sole comprising:

an outsole having a bottom surface comprising an outer elliptical tread and a plurality of nested inner elliptical treads nested within the outer elliptical tread, wherein each tread is separated from an adjacent tread by an elliptical groove, wherein each inner tread protrudes lower than the adjacent tread surrounding it, and wherein a center axis of each inner elliptical tread is offset from a center axis of the adjacent tread surrounding it.

16. The sole of claim 15, wherein all inner elliptical treads are offset in the same direction.

17. A sole for an article of footwear, the sole comprising:

an outsole having a bottom surface comprising a plurality of outer elliptical treads and a plurality of inner elliptical treads arranged within each of the outer elliptical treads, wherein each tread is separated from an adjacent tread by an elliptical groove, wherein each inner tread protrudes lower than the adjacent tread surrounding it, and wherein the plurality of outer elliptical treads and the plurality of inner elliptical treads are disposed in a forefoot of the outsole.

18. A sole for an article of footwear, the sole comprising:

an outsole having a bottom surface comprising a plurality of outer elliptical treads and a plurality of inner elliptical treads arranged within each of the outer elliptical treads, wherein each tread is separated from an adjacent tread by an elliptical groove, wherein each inner tread protrudes lower than the adjacent tread surrounding it, and wherein the plurality of outer elliptical treads and the plurality of inner elliptical treads are disposed in a heel of the outsole.

* * * * *